US010782036B2

(12) United States Patent
Martin

(10) Patent No.: US 10,782,036 B2
(45) Date of Patent: Sep. 22, 2020

(54) HEAT DISSIPATION SYSTEMS WITH HYGROSCOPIC WORKING FLUID

(71) Applicant: Energy and Environmental Research Center Foundation, Grand Forks, ND (US)

(72) Inventor: Christopher L. Martin, Grand Forks, ND (US)

(73) Assignee: Energy & Environmental Research Center, Grand Forks, ND (US)

( * ) Notice: Subject to any disclaimer, the term of this patent is extended or adjusted under 35 U.S.C. 154(b) by 0 days.

(21) Appl. No.: 15/617,619

(22) Filed: Jun. 8, 2017

(65) Prior Publication Data

US 2017/0268815 A1 Sep. 21, 2017

Related U.S. Application Data

(63) Continuation of application No. 13/953,332, filed on Jul. 29, 2013, which is a continuation-in-part of application No. 13/040,379, filed on Mar. 4, 2011.

(60) Provisional application No. 61/345,864, filed on May 18, 2010.

(51) Int. Cl.

| | |
|---|---|
| ***F24F 3/14*** | (2006.01) |
| ***F28C 1/14*** | (2006.01) |
| ***F28B 9/06*** | (2006.01) |

(52) U.S. Cl.

CPC ..... *F24F 3/1417* (2013.01); *F28B 9/06* (2013.01); *F28C 1/14* (2013.01)

(58) Field of Classification Search

CPC ..... F28C 1/00; F28C 1/02; F28C 2001/006; F01K 9/003

See application file for complete search history.

(56) References Cited

U.S. PATENT DOCUMENTS 2,262,954 A 11/1941 Mattern et al.
2,355,828 A 8/1944 Taylor
(Continued)

FOREIGN PATENT DOCUMENTS

CN 105579804 A 5/2016
EP 0051893 A1 5/1982
(Continued)

OTHER PUBLICATIONS

"U.S. Appl. No. 13/953,332, Advisory Action dated May 30, 2017", 6 pgs.

(Continued)

*Primary Examiner* — Christopher R Zerphey
(74) *Attorney, Agent, or Firm* — Schwegman Lundberg & Woessner, P.A.

(57) ABSTRACT

A heat dissipation system apparatus and method of operation using hygroscopic working fluid for use in a wide variety of environments for absorbed water in the hygroscopic working fluid to be released to minimize water consumption in the heat dissipation system apparatus for effective cooling in environments having little available water for use in cooling systems. The system comprises a low-volatility, hygroscopic working fluid to reject thermal energy directly to ambient air. The low-volatility and hygroscopic nature of the working fluid prevents complete evaporation of the fluid and a net consumption of water for cooling, and direct-contact heat exchange allows for the creation of large interfacial surface areas for effective heat transfer. Specific methods of operation prevent the crystallization of the desiccant from the hygrosopic working fluid under various environmental conditions.

23 Claims, 14 Drawing Sheets

(56) References Cited

U.S. PATENT DOCUMENTS

| | | | | |
|---|---|---|---|---|
| 2,525,045 | A | 10/1950 | Richardson | |
| 2,732,192 | A * | 1/1956 | Johnson et al. | F28C 1/00 261/116 |
| 3,635,042 | A | 1/1972 | Spangemacher | |
| 3,666,246 | A | 5/1972 | Cohen | |
| 4,121,541 | A | 10/1978 | Kneissl et al. | |
| 4,182,131 | A | 1/1980 | Marshall et al. | |
| 4,340,572 | A | 7/1982 | Ben-shmuel et al. | |
| 4,380,910 | A | 4/1983 | Hood et al. | |
| 4,662,902 | A * | 5/1987 | Meyer-Pittroff | C02F 1/16 261/160 |
| 4,819,447 | A | 4/1989 | Assaf | |
| 4,931,187 | A | 6/1990 | Derham et al. | |
| 4,984,434 | A | 1/1991 | Peterson et al. | |
| 5,022,241 | A | 6/1991 | Wilkinson | |
| 5,193,352 | A | 3/1993 | Smith et al. | |
| 5,203,161 | A | 4/1993 | Lehto | |
| 5,206,002 | A | 4/1993 | Skelley et al. | |
| 5,351,497 | A | 10/1994 | Lowenstein | |
| 5,407,606 | A * | 4/1995 | Bowman | F28C 1/02 261/109 |
| 5,450,731 | A | 9/1995 | Diperi | |
| 5,790,972 | A | 8/1998 | Kohlenberger | |
| 5,884,492 | A | 3/1999 | Zwicky et al. | |
| 6,134,903 | A | 10/2000 | Potnis et al. | |
| 6,385,987 | B2 | 5/2002 | Schlom et al. | |
| 6,394,174 | B1 | 5/2002 | Hsieh | |
| 6,595,011 | B1 | 7/2003 | Forgy | |
| 6,854,278 | B2 | 2/2005 | Maisotsenko et al. | |
| 7,210,671 | B2 * | 5/2007 | Bosman | F28C 1/02 261/29 |
| 7,269,966 | B2 | 9/2007 | Lowenstein et al. | |
| 7,343,746 | B2 | 3/2008 | Pierson | |
| 7,360,375 | B2 | 4/2008 | Mola et al. | |
| 7,823,396 | B2 | 11/2010 | Al-mayahi et al. | |
| 8,223,495 | B1 | 7/2012 | Carlson et al. | |
| RE44,815 | E | 3/2014 | Pierson | |
| 9,045,351 | B2 | 6/2015 | Wallace | |
| 9,927,178 | B1 | 3/2018 | Srinivas et al. | |
| 10,260,761 | B2 | 4/2019 | Martin | |
| 2001/0032477 | A1 | 10/2001 | Schlom et al. | |
| 2002/0020185 | A1 | 2/2002 | Carr | |
| 2004/0112077 | A1 | 6/2004 | Forkosh et al. | |
| 2004/0261440 | A1 | 12/2004 | Forkosh et al. | |
| 2005/0056042 | A1 | 3/2005 | Bourne et al. | |
| 2005/0109052 | A1 | 5/2005 | Albers et al. | |
| 2007/0101746 | A1 | 5/2007 | Schlom et al. | |
| 2008/0307802 | A1 | 12/2008 | Forkosh | |
| 2011/0101549 | A1 | 5/2011 | Miyauchi et al. | |
| 2011/0283718 | A1 | 11/2011 | Ueda | |
| 2011/0283720 | A1 | 11/2011 | Martin | |
| 2012/0255908 | A1 | 10/2012 | Duke et al. | |
| 2013/0305752 | A1 | 11/2013 | Martin | |
| 2015/0292754 | A1 | 10/2015 | Mongar | |
| 2016/0033192 | A1 | 2/2016 | Martin | |
| 2018/0202671 | A1 | 7/2018 | Martin | |

FOREIGN PATENT DOCUMENTS

| | | | |
|---|---|---|---|
| EP | 3156751 | A1 | 4/2017 |
| EP | 3156751 | B1 | 6/2018 |
| IN | 201617002792 | A | 8/2016 |
| JP | 2009287795 | A | 12/2009 |
| WO | WO-2015017144 | A2 | 2/2015 |
| WO | WO-2015017144 | A3 | 2/2015 |

OTHER PUBLICATIONS

"U.S. Appl. No. 13/953,332, Advisory Action dated Nov. 2, 2015", 4 pgs.
"U.S. Appl. No. 13/953,332, Examiner Interview Summary dated Apr. 4, 2016", 3 pgs.
"U.S. Appl. No. 13/953,332, Final Office Action dated Mar. 21, 2017", 10 pgs.
"U.S. Appl. No. 13/953,332, Final Office Action dated Aug. 31, 2015", 9 pgs.
"U.S. Appl. No. 13/953,332, Non Final Office Action dated May 29, 2015", 9 pgs.
"U.S. Appl. No. 13/953,332, Non Final Office Action dated Dec. 12, 2016", 10 pgs.
"U.S. Appl. No. 13/953,332, Response filed Mar. 9, 2017 to Non Final Office Action dated Dec. 12, 2016", 13 pgs.
"U.S. Appl. No. 13/953,332, Response filed May 15, 2015 to Restriction Requirement dated Apr. 14, 2015", 8 pgs.
"U.S. Appl. No. 13/953,332, Response filed May 18, 2017 to Final Office Action dated Mar. 21, 2017", 13 pgs.
"U.S. Appl. No. 13/953,332, Response filed Aug. 19, 2015 to Non Final Office Action dated May 29, 2015", 12 pgs.
"U.S. Appl. No. 13/953,332, Response filed Oct. 23, 2015 to Final Office Action dated Aug. 31, 2015", 11 pgs.
"U.S. Appl. No. 13/953,332, Response filed Nov. 4, 2015 to Final Office Action dated Aug. 31, 2015", 11 pgs.
"U.S. Appl. No. 13/953,332, Restriction Requirement dated Apr. 14, 2015", 6 pgs.
"Chinese Application Serial No. 201480053735.9, Office Action dated Mar. 1, 2017", (English Translation), 15 pgs.
"Chinese Application Serial No. 20148005373539, Voluntary Amendment filed Jun. 15, 2016", 10 pgs.
"European Application Serial No. 14748054.5, Response filed May 2, 2017 to Deadline to Respond to Notification to Correct Deficiency", 6 pgs.
"European Application Serial No. 14748054.5, Response filed Sep. 8, 2016 to Communication pursuant to Rules 161(1) and 162 EPC dated Mar. 22, 2016", 9 pgs.
"European Application Serial No. 16194035.8, Extended European Search Report dated Mar. 6, 2017", 8 pgs.
"European Application Serial No. 16194035.8, Invitation to Remedy Deficiencies dated Oct. 31, 2016", 1 pg.
"European Application Serial No. 16194035.8, Response filed Jan. 9, 2017 to Invitation to Remedy Deficiencies dated Oct. 31, 2016", 4 pgs.
"International Application Serial No. PCT/US2014/047230, International Application Serial No. PCT/US2014/047230, International Preliminary Report on Patentability dated Feb. 11, 2016", 7 pgs.
"International Application Serial No. PCT/US2014/047230, International Search Report dated Aug. 18, 2015", 3 pgs.
"International Application Serial No. PCT/US2014/047230, Written Opinion dated Aug. 18, 2015", 5 pgs.
"U.S. Appl. No. 13/953,332, Non Final Office Action dated Jan. 30, 2018", 17 pgs.
"U.S. Appl. No. 13/953,332, Response filed Jan. 8, 2018 to Final Office Action dated Oct. 12, 2017", 19 pgs.
"U.S. Appl. No. 13/953,332 Response filed Apr. 25, 2018 to Non-Final Office Action dated Jan. 30, 2018.pdf".
"U.S. Appl. No. 14/884,450, Advisory Action dated Mar. 21, 2018", 5 pgs.
"U.S. Appl. No. 14/884,450, Examiner Interview Summary dated Feb. 27, 2018", 3 pgs.
"U.S. Appl. No. 14/884,450, Final Office Action dated Dec. 29, 2017", 20 pgs.
"U.S. Appl. No. 14/884,450, Non Final Office Action dated Apr. 16, 2018", 17 pgs.
"U.S. Appl. No. 14/844,450, Response filed Mar. 29, 2018 to Advisory Action dated Mar. 21, 2018", Response to Advisory Action, 14 pgs.
"U.S. Appl. No. 14/884,450, Response filed Feb. 27, 2018 to Final Office Action dated Dec. 29, 2017.pdf", 14 pgs.
"European Application Serial No. 14748054.5, Communication Pursuant to Article 94(3) EPC dated Feb. 9, 2018", 5 pgs.
U.S. Appl. No. 15/918,916, filed Mar. 12, 2018, Hygroscopic Cooling Tower for Waste Water Disposal.
"U.S. Appl. No. 13/953,332 Response filed Aug. 21, 2018 to Final Office Action dated May 25, 2018", 21 pgs.
"U.S. Appl. No. 13/953,332, Advisory Action dated Aug. 6, 2018", 3 pgs.

(56) References Cited

OTHER PUBLICATIONS

"U.S. Appl. No. 13/953,332, Examiner Interview Summary dated Jul. 18, 2018", 3 pgs.
"U.S. Appl. No. 13/953,332, Final Office Action dated May 25, 2018", 17 pgs.
"U.S. Appl. No. 13/953,332, Response filed Jul. 23, 2018 to Final Office Action dated May 25, 2018", 21 pgs.
"U.S. Appl. No. 14/884,450, Response filed Jul. 11, 2018 to Non-Final Office Action dated Apr. 16, 2018", 28 pgs.
"European Application Serial No. 14748054.5, Response filed Jun. 19, 2018 to Communication Pursuant to Article 94(3) EPC dated Feb. 9, 2018", 14 pgs.
"U.S. Appl. No. 13/953,332, Final Office Action dated Oct. 12, 2017", 10 pgs.
"U.S. Appl. No. 13/953,332, Non Final Office Action dated Jul. 6, 2017", 12 pgs.
"U.S. Appl. No. 13/953,332, Response filed Jun. 19, 2017 to Advisory Action dated May 30, 2017", 12 pgs.
"U.S. Appl. No. 13/953,332, Response filed Sep. 28, 2017 to Non Final Office Action dated Jul. 6, 2017", 14 pgs.
"U.S. Appl. No. 14/884,450, Non Final Office Action dated Sep. 13, 2017", 16 pgs.
"U.S. Appl. No. 14/884,450, Response filed Aug. 23, 2017 to Restriction Requirement dated Jul. 5, 2017", 8 pgs.
"U.S. Appl. No. 14/884,450, Response filed Dec. 13, 2017 to Non Final Office Action dated Sep. 13, 2017", 16 pgs.
"U.S. Appl. No. 14/884,450, Restriction Requirement dated Jul. 5, 2017", 6 pgs.
"Chinese Application Serial No. 201480053735.9, Office Action dated Sep. 19, 2017", With English Translation, 11 pgs.
"Chinese Application Serial No. 201480053735.9, Office Action Response dated Jul. 3, 2017", w/English Claims, 12 pgs.
"Chinese Application Serial No. 201480053735.9, Response filed Nov. 21, 2017 to Office Action dated Sep. 19, 2017", W/English Claims, 14 pgs.
"European Application Serial No. 16194035.8, Response filed Oct. 10, 2017 to Extended European Search Report dated Mar. 6, 2017", 12 pgs.
"U.S. Appl. No. 13/953,332, Notice of Allowance dated Nov. 28, 2018", 8 pgs.
"U.S. Appl. No. 14/884,450, Examiner Interview Summary dated Nov. 26, 2018", 4 pgs.
"U.S. Appl. No. 14/884,450, Final Office Action dated Sep. 5, 2018", 17 pgs.
"European Application Serial No. 14748054.5, Communication Pursuant to Article 94(3) EPC dated Oct. 10, 2018", 3 pgs.
Biesiadny, et al., "Contingency Power for Small Turboshaft Engines Using Water Injection inot Turbine Cooling Air", NASA, Technical Report 86-C-32, (Jul. 2, 1987).
"U.S. Appl. No. 13/953,332, Corrected Notice of Allowability dated Jan. 3, 2019", 5 pgs.
"U.S. Appl. No. 14/884,450, Response filed Dec. 5, 2018 to Final Office Action dated Sep. 5, 2018", 13 pgs.
"Chinese Application Serial No. 201480053735.9, Notice of Reexamination dated Feb. 18, 2019", w/English Translation, 14 pgs.
"European Application Serial No. 14748054.5, Response filed Feb. 15, 2019 to Communication Pursuant to Article 94(3) EPC dated Oct. 10, 2018", 6 pgs.
"European Application Serial No. 18172484.0, Extended European Search Report dated Nov. 19, 2018", 6 pgs.
"Indian Application No. 201617002792, First Examination Report Received dated Feb. 6, 2019", w/English Translation, 6 pgs.
"Chinese Application Serial No. 201480053735.9, Response filed Apr. 3, 2019 to Notice of Reexamination dated Feb. 18, 2019", w English Claims, 15 pgs.
"U.S. Appl. No. 14/884,450, Non Final Office Action dated May 17, 2019", 19 pgs.
"European Application Serial No. 19161740.6, Response filed May 22, 2019 to Invitation to Remedy Deficiencies dated Mar. 28, 2019", 5 pgs.
"Chinese Application Serial No. 201480053735.9, Notice of Reexamination dated Jul. 31, 2019", w English language summary, 4 pgs.
"U.S. Appl. No. 14/884,450, Response filed Aug. 16, 2019 to Non-Final Office Action dated May 17, 2019", 14 pgs.
"Chinese Application Serial No. 201480053735.9, Response filed Sep. 4, 2019 to Notice of Reexamination dated Jul. 31, 2019", w English Claims, 14 pgs.
"U.S. Appl. No. 14/884,450, Final Office Action dated Oct. 7, 2019", 16 pgs.
"U.S. Appl. No. 14/884,450, Response filed Jan. 3, 2020 to Final Office Action dated Oct. 7, 2019", 14 pgs.
"European Application Serial No. 14748054.5, Communication Pursuant to Article 94(3) EPC dated Dec. 4, 2019", 5 pgs.
"European Application Serial No. 19161740.6, Extended European Search Report dated Sep. 17, 2019", 7 pgs.
"U.S. Appl. No. 15/918,916, Non Final Office Action dated Mar. 24, 2020", 8 pgs.
"European Application Serial No. 14748054.5, Response filed Mar. 24, 2020 to Communication Pursuant to Article 94(3) EPC dated Dec. 4, 2019", 6 pgs.
"European Application Serial No. 19161740.6, Response Filed Apr. 7, 2020 to Extended European Search Report dated Sep. 17, 2019", 14 pgs.
U.S. Appl. No. 13/040,379, filed Mar. 4, 2011, Heat Dissipation Systems With Hygroscopic Working Fluid.
U.S. Appl. No. 61/345,864, filed May 18, 2010, Heat Dissipation Systems With Hygroscopic Working Fluid.
U.S. Appl. No. 13/953,332, filed Jul. 29, 2013, Heat Dissipation Systems With Hygroscopic Working Fluid.
U.S. Appl. No. 14/884,450, filed Oct. 15, 2015, Heat Dissipation Systems With Hygroscopic Working Fluid.

* cited by examiner

HEAT DISSIPATION SYSTEMS WITH HYGROSCOPIC WORKING FLUID

CROSS-REFERENCE TO RELATED APPLICATIONS

This application is a continuation of and claims the benefit of priority under 35 U.S.C. § 120 to U.S. Utility application Ser. No. 13/953,332 entitled "HEAT DISSIPATION SYSTEMS WITH HYGROSCOPIC WORKING FLUID", filed Jul. 29, 2013, which is a continuation-in-part of and claims the benefit of priority under 35 U.S.C. § 120 to U.S. Utility application Ser. No. 13/040,379 entitled "HEAT DISSIPATION SYSTEM WITH HYGROSCOPIC WORKING FLUID," filed Mar. 4, 2011, which claims the benefit under 35 U.S.C. § 119(e) of U.S. Provisional Patent Application Ser. No. 61/345,864 filed May 18, 2010, the disclosures of which are incorporated herein in their entirety by reference.

STATEMENT REGARDING FEDERALLY SPONSORED RESEARCH OR DEVELOPMENT

This invention was made with government support under Cooperative Agreement No. DE-FC26-08NT43291 entitled "EERC-DOE Joint Program on Research and Development for Fossil Energy-Related Resources," awarded by the U.S. Department of Energy (DOE). The government has certain rights in the invention.

FIELD OF THE INVENTION

This invention relates to the dissipation of degraded thermal energy to ambient air.

BACKGROUND OF THE INVENTION

Thermal energy dissipation is a universal task in industry that has largely relied on great quantities of cooling water to satisfy. Common heat rejection processes include steam condensation in thermoelectric power plants, refrigerant condensation in air-conditioning and refrigeration equipment, and process cooling during chemical manufacturing. In the case of power plants and refrigeration systems, it is desired to dissipate thermal energy at the lowest possible temperature with a minimal loss of water to the operating environment for optimum resource utilization.

Where the local environment has a suitable, readily available, low-temperature source of water, e.g., a river, sea, or lake, cooling water can be extracted directly. However, few of these opportunities for cooling are expected to be available in the future because competition for water sources and recognition of the impact of various uses of water sources on the environment are increasing. In the absence of a suitable, readily available coolant source, the only other common thermal sink available at all locations is ambient air. Both sensible heat transfer and latent heat transfer are currently used to reject heat to the air. In sensible cooling, air is used directly as the coolant for cooling one side of a process heat exchanger. For latent cooling, liquid water is used as an intermediate heat-transfer fluid. Thermal energy is transferred to the ambient air primarily in the form of evaporated water vapor, with minimal temperature rise of the air.

These technologies are used routinely in industry, but each one has distinct drawbacks. In the sensible cooling case, air is an inferior coolant compared to liquids, and the resulting efficiency of air-cooled processes can be poor. The air-side heat-transfer coefficient in air-cooled heat exchangers is invariably much lower than liquid-cooled heat exchangers or in condensation processes and, therefore, requires a large heat exchange surface area for good performance. In addition to larger surface area requirements, air-cooled heat exchangers approach the cooling limitation of the ambient dry-bulb temperature of the air used for cooling, which can vary 30° to 40° F. over the course of a day and can hinder cooling capacity during the hottest hours of the day. Air-cooled system design is typically a compromise between process efficiency and heat exchanger cost. Choosing the lowest initial cost option can have negative energy consumption implications for the life of the system.

In latent heat dissipation, the cooling efficiency is much higher, and the heat rejection temperature is more consistent throughout the course of a day since a wet cooling tower will approach the ambient dew point temperature of the air used for cooling instead of the oscillatory dry-bulb temperature of the air used for cooling. The key drawback or problem associated with this cooling approach is the associated water consumption used in cooling, which in many areas is a limiting resource. Obtaining sufficient water rights for wet cooling system operation delays plant permitting, limits site selection, and creates a highly visible vulnerability for opponents of new development.

Prior art U.S. Pat. No. 3,666,246 discloses a heat dissipation system using an aqueous desiccant solution circulated between the steam condenser (thermal load) and a direct-contact heat and mass exchanger in contact with an ambient air flow. In this system, the liquid solution is forced to approach the prevailing ambient dry-bulb temperature and moisture vapor pressure. To prevent excessive drying and precipitation of the hygroscopic desiccant from solution, a portion of the circulating hygroscopic desiccant flow is recycled back to an air contactor without absorbing heat from the thermal load. This results in a lower average temperature in the air contactor and helps to extend the operating range of the system.

The recirculation of unheated hygroscopic desiccant solution is effective for the ambient conditions of approximately 20° C. and approximately 50% relative humidity as illustrated by the example described in U.S. Pat. No. 3,666,246, but in drier, less humid environments, the amount of unheated recirculation hygroscopic desiccant flow must be increased to prevent crystallization of the hygroscopic desiccant solution. As the ambient air's moisture content decreases, the required recirculation flow grows to become a larger and larger proportion of the total flow such that no significant cooling of the condenser is taking place, thereby reducing the ability of the heat dissipation system to cool, in the extreme, to near zero or no significant cooling. Ultimately, once the hygroscopic desiccant is no longer a stable liquid under the prevalent environmental conditions, no amount of recirculation flow can prevent crystallization of the unheated hygroscopic desiccant solution.

Using the instantaneous ambient conditions as the approach condition for the hygroscopic desiccant solution limits operation of the heat dissipation system in U.S. Pat. No. 3,666,246 to a relative humidity of approximately 30% or greater with the preferred $MgCl_2$ hygroscopic desiccant solution. Otherwise, the hygroscopic desiccant may completely dry out and precipitate from solution. This limitation would exclude operation and use of the heat dissipation system described in U.S. Pat. No. 3,666,246 in regions of the world that experience significantly drier weather patterns, less humid air, and are arguably in need of improvements to dry cooling technology.

Additionally, while the heat dissipation system described in U.S. Pat. No. 3,666,246 discloses that the system may alternatively be operated to absorb atmospheric moisture and subsequently evaporate it, the disclosed heat dissipation system design circumvents most of this mode of operation of the heat dissipation system. Assuming that atmospheric moisture has been absorbed into hygroscopic desiccant solution during the cooler, overnight hours, evaporation of water from the hygroscopic desiccant will begin as soon as the ambient temperature begins to warm in the early morning, using the heat dissipation system described in U.S. Pat. No. 3,666,246, since it has no mechanism to curtail excessive moisture evaporation during the early morning transition period and no way to retain excess moisture for more beneficial use later in the daily cycle, such as afternoon, when ambient temperatures and cooling demand are typically higher. Instead, absorbed water in the hygroscopic desiccant in the heat dissipation system will begin evaporating as soon as the hygroscopic desiccant solution's vapor pressure of the heat dissipation system exceeds that of the ambient air, regardless of whether it is productively dissipating thermal energy from the heat load or wastefully absorbing the energy from the ambient air stream.

Improvements have been proposed to these basic cooling systems. Significant effort has gone into hybrid cooling concepts that augment air-cooled condensers with evaporative cooling during the hottest parts of the day. These systems can use less water compared to complete latent cooling, but any increased system performance is directly related to the amount of water-based augmentation, so these systems do not solve the underlying issue of water consumption. Despite the fact that meeting the cooling needs of industrial processes is a fundamental engineering task, significant improvements are still desired, primarily the elimination of water consumption while simultaneously maintaining high-efficiency cooling at reasonable cost.

In summary, there is a need for improved heat dissipation technology relative to current methods. Sensible cooling with air is costly because of the vast heat exchange surface area required and because its heat-transfer performance is handicapped during the hottest ambient temperatures. Latent or evaporative cooling has preferred cooling performance, but it consumes large quantities of water which is a limited resource in some locations.

SUMMARY OF THE INVENTION

A heat dissipation system apparatus and method of operation using hygroscopic working fluid for use in a wide variety of environments for absorbed water in the hygroscopic working fluid to be released to minimize water consumption in the heat dissipation system apparatus for effective cooling in environments having little available water for use in cooling systems.

DETAILED DESCRIPTION OF THE INVENTION

Figure 1:
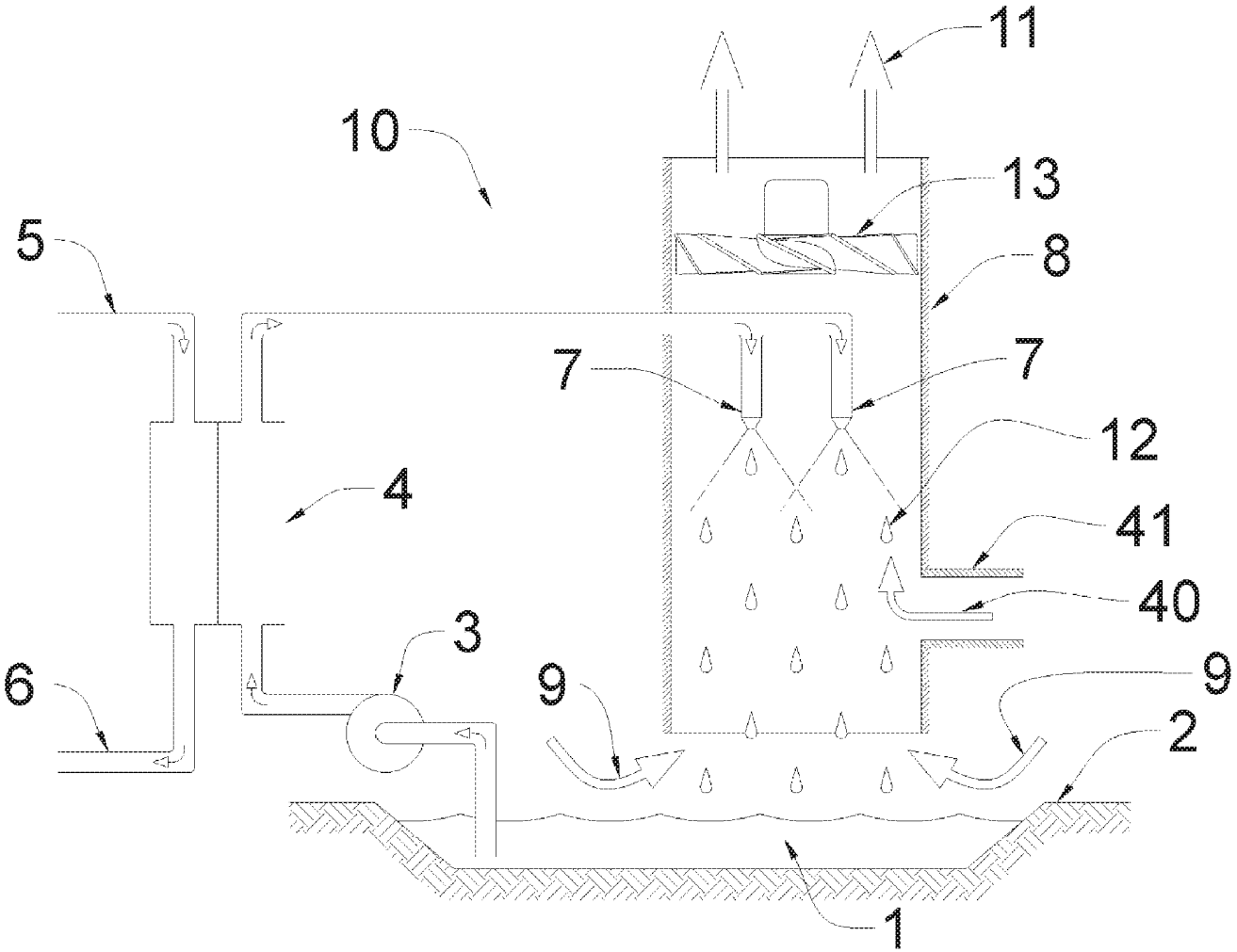
FIG. 1 is a schematic of the heat dissipation system according to one embodiment of the present invention.

The heat dissipation systems described herein are an improvement to the state of the art in desiccant-based (hygroscopic) fluid cooling systems by incorporating means to regulate the amount of sensible heat transfer, e.g., heat exchanged having as its sole effect a change of temperature versus latent heat transfer, e.g., heat exchanged without change of temperature, taking place in heat dissipation system so that the desiccant-based hygroscopic fluid remains stable (hygroscopic desiccant in solution) to prevent crystallization of the desiccant from the desiccant-based hygroscopic fluid. In simple form, the heat dissipation system comprises at least one hygroscopic desiccant-to-air direct-contact heat exchanger for heat exchange having combined sensible and latent heat transfer, at least one sensible heat exchanger for heat exchange with a change of temperature of the heat exchange fluid used, and at least one desiccant (hygroscopic) fluid for use as the heat exchange fluid in the heat dissipation system to exchange water with the atmosphere to maintain the water content of the desiccant (hygroscopic) fluid. In the heat dissipation systems described herein, thermal energy is dissipated at a higher (but still allowable) temperature during cooler ambient periods in order to maintain cooling capacity during peak ambient temperatures. In some embodiments, preventing crystallization of the desiccant includes preventing substantially all crystallization of the desiccant. In some embodiments, preventing crystallization of the desiccant can include substantially preventing crystallization of the desiccant but allowing less than a particular small amount of crystallization to occur, for example, wherein no more than about 0.000,000,001 wt % or less of the desiccant present in solution crystallizes, or such as no more than about 0.000,000,01, 0.000,000,1, 0.000,001, 0.000,01, 0.000,1, 0.001, 0.01, 0.1, 1, 1, 1.5, 2, 3, 4, 5 wt %, or no more than about 10 wt % of the desiccant present in solution crystallizes.

The heat dissipation systems described herein include counterflowing, staged sequences of the direct-contact air-fluid latent heat exchangers and sensible heat exchangers that interface with the thermal load. Feedback from one stage of the direct-contact air-fluid latent heat exchanger is passed to another stage of the direct-contact air-fluid latent heat exchanger in the form of increased vapor pressure in the air stream and reduced temperature of the hygroscopic desiccant working fluid servicing the thermal load. Combined, such counterflowing, staged sequences of the direct-contact air-fluid latent exchangers and the sensible heat exchangers that interface with the thermal load reduce the proportion of the thermal load passed to the initial, cooler stages of the direct-contact air-fluid latent heat exchangers (which contain much of the moisture absorbed during cooler periods) and prevent excessive evaporation from the final, hotter stages of the direct-contact air-fluid latent heat exchangers.

The heat dissipation systems described herein each circulate at least one (or multiple differing types of) hygroscopic working fluid to transfer heat from a process requiring cooling directly to the ambient air. The hygroscopic fluid is in liquid phase at conditions in which it is at thermal and vapor pressure equilibrium with the expected local ambient conditions so that the desiccant-based hygroscopic fluid remains stable to prevent crystallization of the desiccant from the desiccant-based hygroscopic fluid. The hygroscopic fluid comprises a solution of a hygroscopic substance and water. In one embodiment, the hygroscopic substance itself should have a very low vapor pressure compared to water in order to prevent significant loss of the hygroscopic component of the fluid during cycle operation. The hygroscopic component can be a pure substance or a mixture of substances selected from compounds known to attract moisture vapor and form liquid solutions with water that have reduced water vapor pressures. The hygroscopic component includes all materials currently employed for desiccation operations or dehumidifying operations, including hygroscopic inorganic salts, such as LiCl, LiBr, $CaCl_2$, $ZnCl_2$; hygroscopic organic compounds, such as ethylene glycol, propylene glycol, triethylene glycol; or inorganic acids, such as $H_2SO_4$ and the like.

Thermal energy is removed from the process in a suitable sensible heat exchanger having on one side thereof, the flow of process fluid, and on the other side thereof, the flow of hygroscopic working fluid coolant. This sensible heat exchanger can take the form of any well-known heat exchange device, including shell-and-tube heat exchangers, plate-and-frame heat exchangers, or falling-film heat exchangers. The process fluid being cooled includes a single-phase fluid, liquid, or gas or can be a fluid undergoing phase change, e.g., condensation of a vapor into a liquid. Consequently, the thermal load presented by the hygroscopic process fluid can be sensible, e.g., with a temperature change, or latent which is isothermal. Flowing through the other side of the sensible heat exchange device, the hygroscopic working fluid coolant can remove heat sensibly, such as in a sealed device with no vapor space, or it can provide a combination of sensible and latent heat removal if partial evaporation of the moisture in solution is allowed, such as in the film side of a falling-film type heat exchanger.

After thermal energy has been transferred from the process fluid to the hygroscopic working fluid using the sensible heat exchanger, the hygroscopic fluid is circulated to an air-contacting latent heat exchanger where it is exposed directly to ambient air for heat dissipation. The latent heat exchanger is constructed in such a way as to generate a large amount of interfacial surface area between the desiccant solution and air. Any well-known method may be used to generate the interfacial area, such as by including a direct spray of the liquid into the air, a flow of hygroscopic solution distributed over random packings, or a falling film of hygroscopic liquid solution down a structured surface. Flow of the air and hygroscopic desiccant solution streams can be conducted in the most advantageous way for a particular situation, such as countercurrent where the hygroscopic desiccant solution may be flowing down by gravity and the air is flowing up, crossflow where the flow of hygroscopic desiccant solution is in an orthogonal direction to airflow, cocurrent where the hygroscopic desiccant solution and air travel in the same direction, or any intermediary flow type.

Heat- and mass-transfer processes inside the latent heat exchanger are enhanced by convective movement of air through the latent heat exchanger. Convective flow may be achieved by several different means or a combination of such different means. The first means for convective airflow is through natural convection mechanisms such as by the buoyancy difference between warmed air inside the latent heat exchanger and the cooler and the surrounding ambient air. This effect would naturally circulate convective airflow through a suitably designed chamber in which the air is being heated by the warmed solution in the latent heat exchanger. Another means for convective airflow includes the forced flow of air generated by a fan or blower for flowing air through the latent heat exchanger. A further convective airflow means includes inducing airflow using momentum transfer from a jet of solution pumped out at sufficient mass flow rate and velocity into the latent heat exchanger.

Inside the latent heat exchanger, an interrelated process of heat and mass transfer occurs between the hygroscopic solution used as the working fluid and the airflow that ultimately results in the transfer of thermal energy from the solution to the air. When the air and hygroscopic solution are in contact, they will exchange moisture mass and thermal energy in order to approach equilibrium, which for a hygroscopic liquid and its surrounding atmosphere requires a match of temperature and water vapor pressure. Since the hygroscopic solution's vapor pressure is partially dependent on temperature, the condition is often reached where the hygroscopic solution has rapidly reached its equivalent dew point temperature by primarily latent heat transfer (to match the ambient vapor pressure), and then further evaporation or condensation is limited by the slower process of heat transfer between the air and the hygroscopic solution (to match the ambient temperature).

The net amount of heat and mass transfer within the latent heat exchanger is dependent on the specific design of the latent heat exchanger and the inlet conditions of the hygroscopic solution and the ambient air. However, the possible outcomes as hygroscopic solution passes through the latent heat exchanger include situations where the hygroscopic solution can experience a net loss of moisture (a portion of the thermal energy contained in the solution is released as latent heat during moisture evaporation; this increases the humidity content of the airflow), the hygroscopic solution can experience a net gain in moisture content (such occurs when the vapor pressure in the air is higher than in the solution, and moisture is absorbed by the hygroscopic solution having the latent heat of absorption released into the hygroscopic solution and being transferred sensibly to the air), and the hygroscopic solution is in a steady state where no net moisture change occurs (any evaporation being counterbalanced by an equivalent amount of reabsorption, or vice versa).

After passing through the latent heat exchanger, the hygroscopic solution has released thermal energy to the ambient air either through sensible heat transfer alone or by a combination of sensible heat transfer and latent heat transfer (along with any concomitant moisture content change). The hygroscopic solution is then collected in a reservoir, the size of which will be selected to offer the best dynamic performance of the overall cooling system for a given environmental location and thermal load profile. It can be appreciated that the reservoir can alter the time constant of the cooling system in response to dynamic changes in environmental conditions. For example, moisture absorption in the ambient atmosphere will be most encouraged during the night and early morning hours, typically when diurnal temperatures are at a minimum, and an excess of moisture may be collected. On the other extreme, moisture evaporation in the ambient atmosphere will be most prevalent during the afternoon when diurnal temperatures have peaked, and there could be a net loss of hygroscopic solution moisture content. Therefore, for a continuously operating system in the ambient atmosphere, the reservoir and its method of operation can be selected so as to optimize the storage of excess moisture gained during the night so that it can be evaporated during the next afternoon, to maintain cooling capacity and ensure that the desiccant-based hygroscopic fluid remains stable to prevent crystallization of the hygroscopic desiccant from the desiccant-based hygroscopic fluid.

The reservoir itself can be a single mixed tank where the average properties of the solution are maintained. The reservoir also includes a stratified tank or a series of separate tanks intended to preserve the distribution of water collection throughout a diurnal cycle so that collected water can be metered out to provide maximum benefit.

The present heat dissipation system includes the use of a hygroscopic working fluid to remove thermal energy from a process stream and dissipate it to the atmosphere by direct contact of the working fluid and ambient air. This enables several features that are highly beneficial for heat dissipation systems, including 1) using the working fluid to couple the concentrated heat-transfer flux in the process heat exchanger to the lower-density heat-transfer flux of ambient air heat dissipation, 2) allowing for large interfacial surface areas between the working fluid and ambient air, 3) enhancing working fluid-air heat-transfer rates with simultaneous mass transfer, and 4) moderating daily temperature fluctuations by cyclically absorbing and releasing moisture vapor from and to the air.

Referring to drawing FIG. 1, one embodiment of a heat dissipation system 10 is illustrated using a hygroscopic working fluid 1 in storage reservoir 2 drawn by pump 3 and circulated through process sensible heat exchanger 4. In the process heat exchanger, the hygroscopic working fluid removes thermal energy from the process fluid that enters hot-side inlet 5 and exits through hot-side outlet 6. The process fluid can be a single phase (gas or liquid) that requires sensible cooling or it could be a two-phase fluid that undergoes a phase change in the process heat exchanger, e.g., condensation of a vapor into a liquid.

After absorbing thermal energy in process heat exchanger 4, the hygroscopic working fluid is routed to distribution nozzles 7 where it is exposed in a countercurrent fashion to air flowing through air contactor latent heat exchanger 8. Ambient airflow through the air contactor in drawing FIG. 1 is from bottom ambient air inlet 9 vertically to top air outlet 11 and is assisted by the buoyancy of the heated air and by powered fan 13. Distributed hygroscopic working fluid 12 in the air contactor flows down, countercurrent to the airflow by the pull of gravity. At the bottom of air contactor latent heat exchanger 8, the hygroscopic working fluid is separated from the inlet airflow and is returned to stored solution 1 in reservoir 2.

In air contactor latent heat exchanger 8, both thermal energy and moisture are exchanged between the hygroscopic working fluid and the airflow, but because of the moisture retention characteristics of the hygroscopic solution working fluid, complete evaporation of the hygroscopic working fluid is prevented and the desiccant-based hygroscopic working fluid remains stable (hygroscopic desiccant in solution) to prevent crystallization of the desiccant from the desiccant-based hygroscopic fluid.

If the heat dissipation system 10 is operated continuously with unchanging ambient air temperature, ambient humidity, and a constant thermal load in process sensible heat exchanger 4, a steady-state temperature and concentration profile will be achieved in air contactor latent heat exchanger 8. Under these conditions, the net moisture content of stored hygroscopic working fluid 1 will remain unchanged. That is not to say that no moisture is exchanged between distributed hygroscopic working fluid 12 and the airflow in air contactor latent heat exchanger 8, but it is an indication that any moisture evaporated from hygroscopic working fluid 12 is reabsorbed from the ambient airflow before the hygroscopic solution is returned to reservoir 2.

However, prior to reaching the aforementioned steady-state condition and during times of changing ambient conditions, heat dissipation system 10 may operate with a net loss or gain of moisture content in hygroscopic working fluid 1. When operating with a net loss of hygroscopic working fluid moisture, the equivalent component of latent thermal energy contributes to the overall cooling capacity of the heat dissipation system 10. In this case, the additional cooling capacity is embodied by the increased moisture vapor content of airflow 11 exiting air contactor latent heat exchanger 8.

Conversely, when operating with a net gain of hygroscopic working fluid moisture (water) content, the equivalent component of latent thermal energy must be absorbed by the hygroscopic working fluid and dissipated to the airflow by sensible heat transfer. In this case, the overall cooling capacity of the heat dissipation system 10 is diminished by the additional latent thermal energy released to the hygroscopic working fluid. Airflow 11 exiting air contactor latent heat exchanger 8 will now have a reduced moisture content compared to inlet ambient air 9.

As an alternative embodiment of heat dissipation system 10 illustrated in drawing FIG. 1, the heat dissipation system 10 uses the supplementation of the relative humidity of inlet ambient air 9 with supplemental gas stream 40 entering through supplemental gas stream inlet 41. When used, gas stream 40 can be any gas flow containing sufficient moisture vapor including ambient air into which water has been evaporated either by misting or spraying, an exhaust stream from a drying process, an exhaust stream of high-humidity air displaced during ventilation of conditioned indoor spaces, an exhaust stream from a wet evaporative cooling tower, or a flue gas stream from a combustion source and the associated flue gas treatment systems. The benefit of using supplemental gas stream 40 is to enhance the humidity level in air contactor latent heat exchanger 8 and encourage absorption of moisture into dispersed hygroscopic working fluid 12 in climates having low ambient humidity. It is also understood that supplemental gas stream 40 would only be active when moisture absorption is needed to provide a net benefit to cyclic cooling capacity, e.g., where the absorbed moisture would be evaporated during a subsequent time of peak cooling demand or when supplemental humidity is needed to prevent excessive moisture (water) loss from the hygroscopic working fluid so that the desiccant-based hygroscopic fluid remains stable (hygroscopic desiccant in solution) to prevent crystallization of the desiccant from the desiccant-based hygroscopic fluid.

Figure 2A:
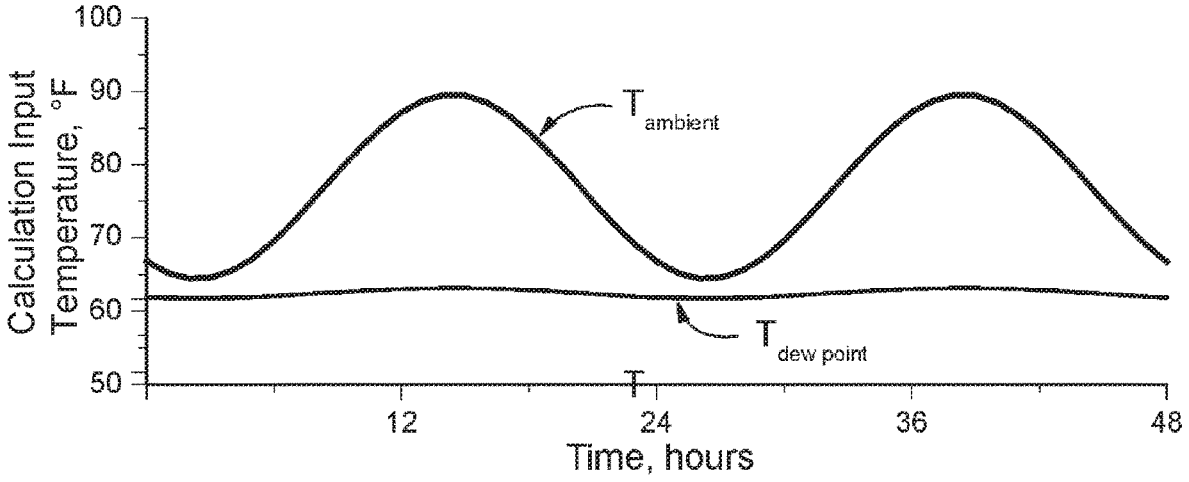
FIG. 2A is a chart depicting the input temperature conditions used to calculate the dynamic response of one embodiment of the present invention.

With the operation of the heat dissipation system 10 described herein and the effects of net moisture change set forth, the performance characteristics of cyclic operation can be appreciated. Illustrated in drawing FIG. 2A is a plot of the cyclic input conditions of ambient air dry-bulb temperature and dew point temperature. The cycle has a period of 24 hours and is intended to be an idealized representation of a diurnal temperature variation. The moisture content of the air is constant for the input data of drawing FIG. 2A since air moisture content does not typically vary dramatically on a diurnal cycle.

Figure 2B:
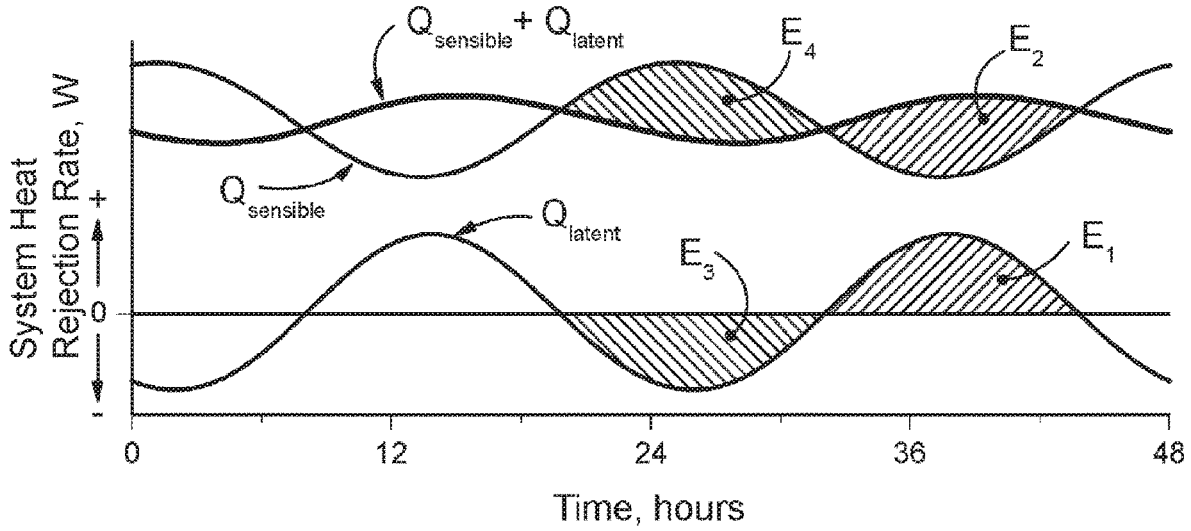
FIG. 2B is a chart depicting the calculated components of heat transfer of the present invention in response to the cyclical input temperature profile of FIG. 2A.

Illustrated in drawing FIG. 2B is the calculated heat-transfer response of the present invention corresponding to the input data of drawing FIG. 2A. The two components of heat transfer are sensible heat transfer and latent heat transfer, and their sum represents the total cooling capacity of the system. As shown in drawing FIG. 2B, the sensible component of heat transfer ($Q_{sensible}$) varies out of phase with the ambient temperature since sensible heat transfer is directly proportional to the hygroscopic working fluid and the airflow temperature difference (all other conditions remaining equal). In practice, a conventional air-cooled heat exchanger is limited by this fact. In the case of a power plant steam condenser, this is the least desirable heat-transfer limitation since cooling capacity is at a minimum during the hottest part of the day, which frequently corresponds to periods of maximum demand for power generation.

The latent component of heat transfer illustrated in drawing FIG. 2B ($Q_{latent}$) is dependent on the ambient moisture content and the moisture content and temperature of the hygroscopic working fluid. According to the sign convention used in drawing FIG. 2B, when the latent heat-transfer component is positive, evaporation is occurring with a net loss of moisture, and the latent thermal energy is dissipated to the ambient air; when the latent component is negative, the hygroscopic solution is absorbing moisture, and the latent energy is being added to the working fluid, thereby diminishing overall cooling capacity. During the idealized diurnal cycle illustrated in drawing FIG. 2A, the latent heat-transfer component illustrated in drawing FIG. 2B indicates that moisture absorption and desorption occur alternately as the ambient temperature reaches the cycle minimum and maximum, respectively. However, over one complete cycle, the net water transfer with the ambient air is zero, e.g., the moisture absorbed during the night equals the moisture evaporated during the next day, so there is no net water consumption.

The net cooling capacity of the heat dissipation system 10 is illustrated in drawing FIG. 2B as the sum of the sensible and latent components of heat transfer ($Q_{sensible}+Q_{latent}$). As illustrated, the latent component of heat transfer acts as thermal damping for the entire system by supplementing daytime cooling capacity with evaporative cooling, region $E_1$ illustrated in drawing FIG. 2B. This evaporative heat transfer enhances overall heat transfer by compensating for declining sensible heat transfer during the diurnal temperature maximum, region $E_2$. This is especially beneficial for cases like a power plant steam condenser where peak conversion efficiency is needed during the hottest parts of the day.

The cost of this boost to daytime heat transfer comes at night when the absorbed latent energy, region $E_3$, is released into the working fluid and must be dissipated to the airflow. During this time, the total system cooling capacity of heat dissipation system 10 is reduced by an equal amount from its potential value, region $E_4$. However, this can be accommodated in practice since the nighttime ambient temperature is low and overall heat transfer is still acceptable. For a steam power plant, the demand for peak power production is also typically at a minimum at night.

Regarding air contactor heat exchanger configuration, direct contact of the hygroscopic working fluid and surrounding air allows the creation of significant surface area with fewer material and resource inputs than are typically required for vacuum-sealed air-cooled condensers or radiators. The solution-air interfacial area can be generated by any means commonly employed in industry, e.g., spray contactor heat exchanger, wetted packed bed heat exchanger (with regular or random packings), or a falling-film contactor heat exchanger.

Air contactor heat exchanger 8, illustrated in drawing FIG. 1, is illustrated as a counterflow spray contactor heat exchanger. While the spray arrangement is an effective way to produce significant interfacial surface area, in practice such designs can have undesirable entrained aerosols carried out of the spray contactor heat exchanger by the airflow. An alternate embodiment of the air contactor heat exchanger to prevent entrainment is illustrated in drawing FIG. 3, which is a crossflow, falling-film contactor heat exchanger designed to minimize droplet formation and liquid entrainment. Particulate sampling across such an experimental device has demonstrated that there is greatly reduced propensity for aerosol formation with this design.

Figure 3:
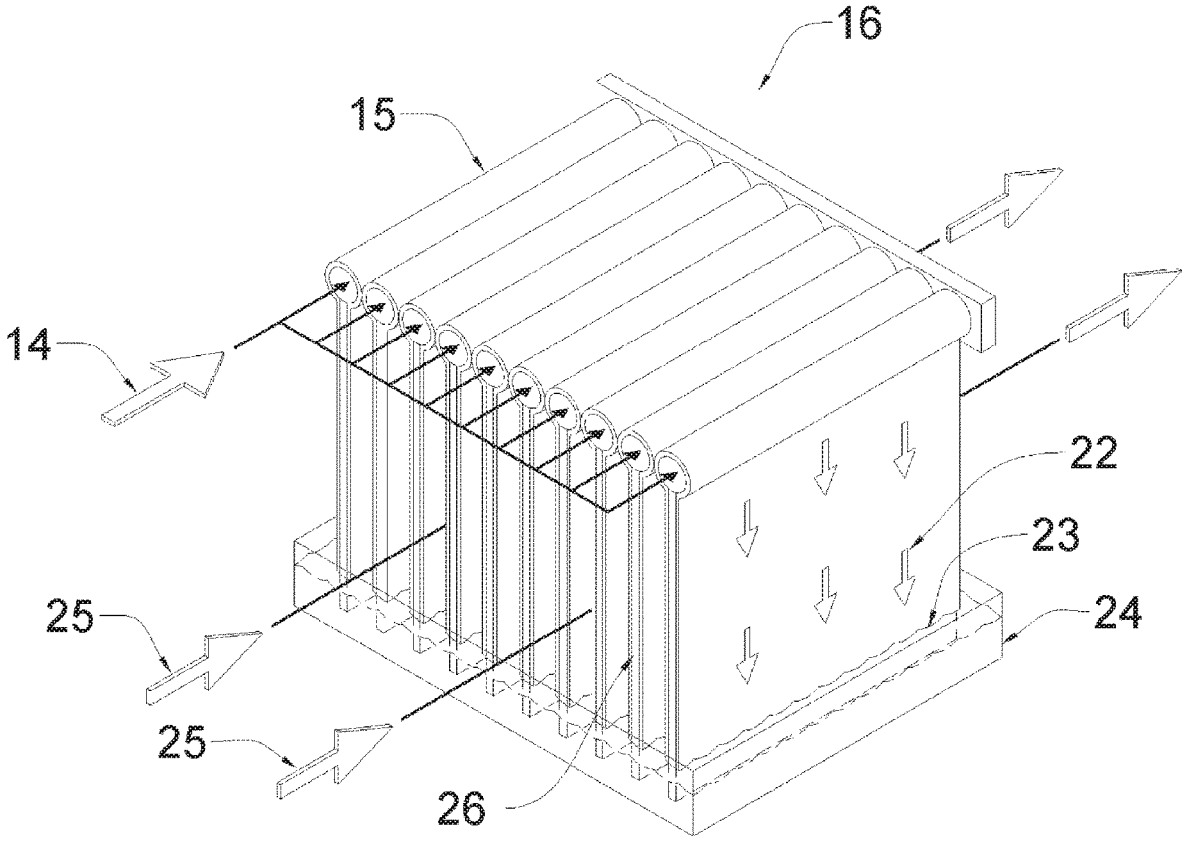
FIG. 3 is a schematic of a cross-flow air contactor depicting an alternate embodiment of the present invention.
Figure 4:
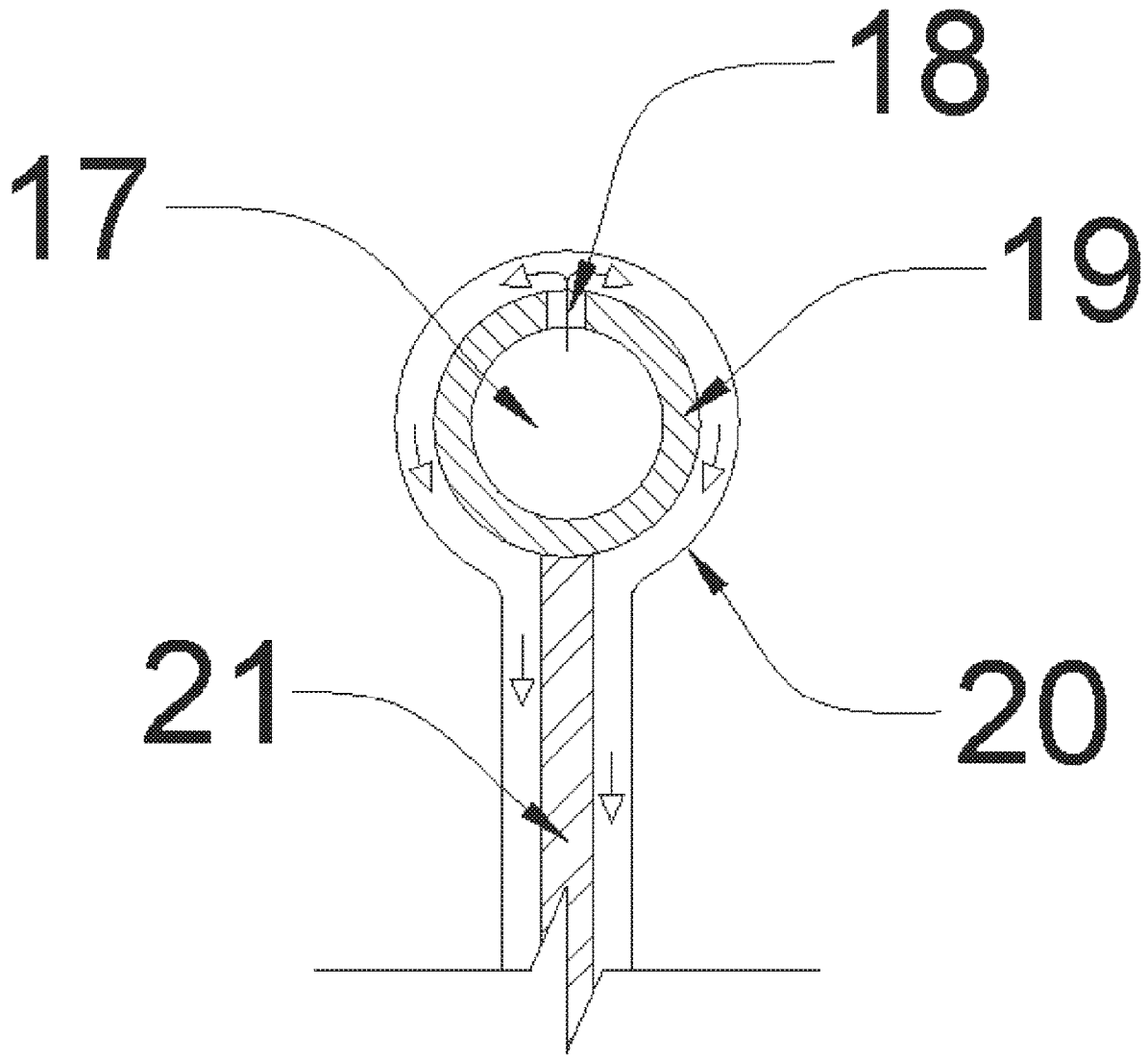
FIG. 4 is a cross-sectional detail of one of the tube headers shown in the air contactor of FIG. 3.

Illustrated in drawing FIG. 3, inlet hygroscopic working fluid 14 is pumped into distribution headers at the top of falling-film contactor heat exchanger 16. Referring to drawing FIG. 4, which is a cross section of an individual distribution header, hygroscopic working fluid 17 is pumped through distribution holes 18 located approximately perpendicular (at 90°) to the axis of tube header 19 where it wets falling-film wick 20 constructed from a suitable material such as woven fabric, plastic matting, or metal screen. Film wick support 21 is used to maintain the shape of each wick section. Illustrated in drawing FIG. 3, distributed film 22 of the hygroscopic working fluid solution flows down by gravity all of the way to the surface of working fluid 23 in reservoir 24. Inlet airflow 25 flows horizontally through the air contactor between falling-film sheets 26. In the configuration illustrated in drawing FIG. 3, heat and mass transfer take place between distributed film 22 of hygroscopic working fluid and airflow 25 between falling-film sections 26. While drawing FIG. 3 illustrates a crossflow configuration, it is understood that countercurrent, cocurrent, or mixed flow is also possible with this configuration provided that the desiccant-based hygroscopic fluid remains stable (hygroscopic desiccant in solution) to prevent crystallization of the desiccant from the desiccant-based hygroscopic fluid.

Figure 5A:
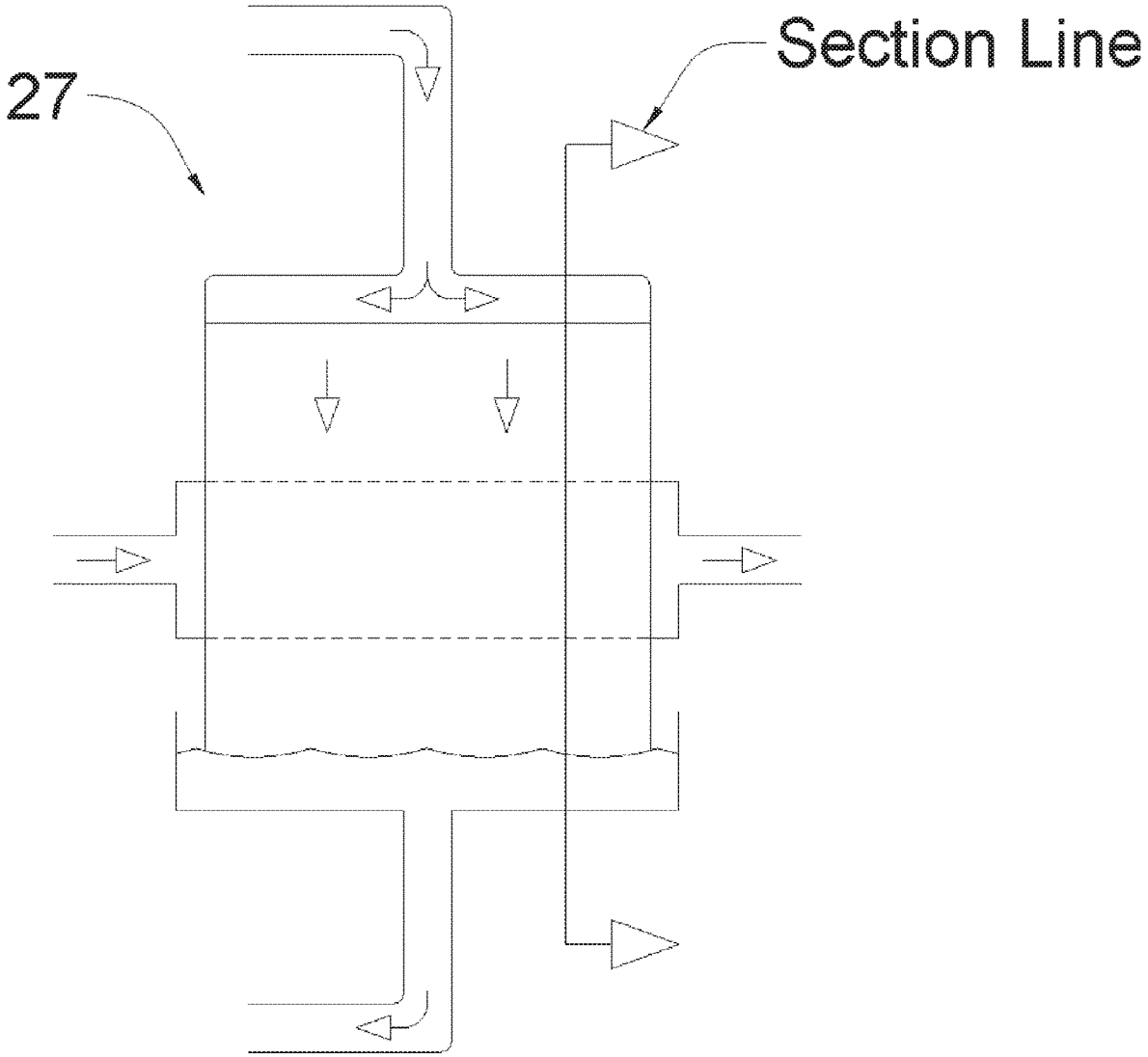
FIG. 5A is a schematic of a falling-film process heat exchanger depicting an alternate embodiment of the present invention.
Figure 5B:
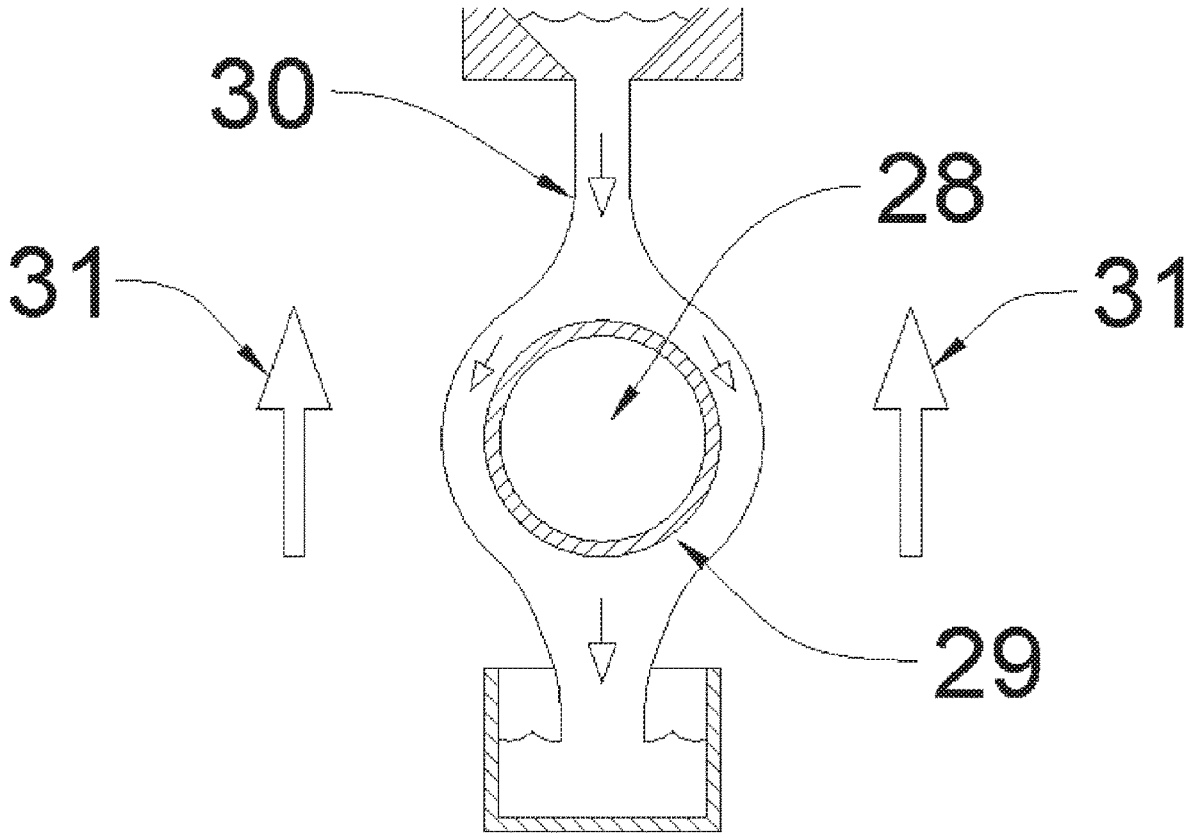
FIG. 5B is a section view of the process heat exchanger in FIG. 5A as viewed from the indicated section line.

Illustrated in drawing FIG. 1, the process heat sensible exchanger 4 can assume the form of any indirect sensible heat exchanger known in the art such as a shell-and-tube or plate-type exchanger. One specific embodiment of the sensible heat exchanger that is advantageous for this service is the falling-film type heat exchanger. Illustrated in drawing FIG. 5A is a schematic of alternate embodiment process heat exchanger 27. Illustrated in drawing FIG. 5B is a cross-sectional view of process heat exchanger 27 viewed along the indicated section line in drawing FIG. 5A. Referring to drawing FIG. 5B, process fluid 28 (which is being cooled) is flowing within tube 29. Along the top of tube 29, cool hygroscopic working fluid 30 is distributed to form a film surface which flows down by gravity over the outside of tube 29. Flowing past the falling-film assembly is airflow 31 which is generated either by natural convection or by forced airflow from a fan or blower.

As hygroscopic working fluid 30 flows over the surface of tube 29, heat is transferred from process fluid 28 through the tube wall and into the hygroscopic working fluid film by conduction. As the film is heated, its moisture vapor pressure rises and may rise to the point that evaporation takes place to surrounding airflow 31, thereby dissipating thermal energy to the airflow. Falling-film heat transfer is well known in the art as an efficient means to achieve high heat-transfer rates with low differential temperatures. One preferred application for the falling-film heat exchanger is when process fluid 28 is undergoing a phase change from vapor to liquid, as in a steam condenser, where temperatures are isothermal and heat flux can be high.

Figure 6:
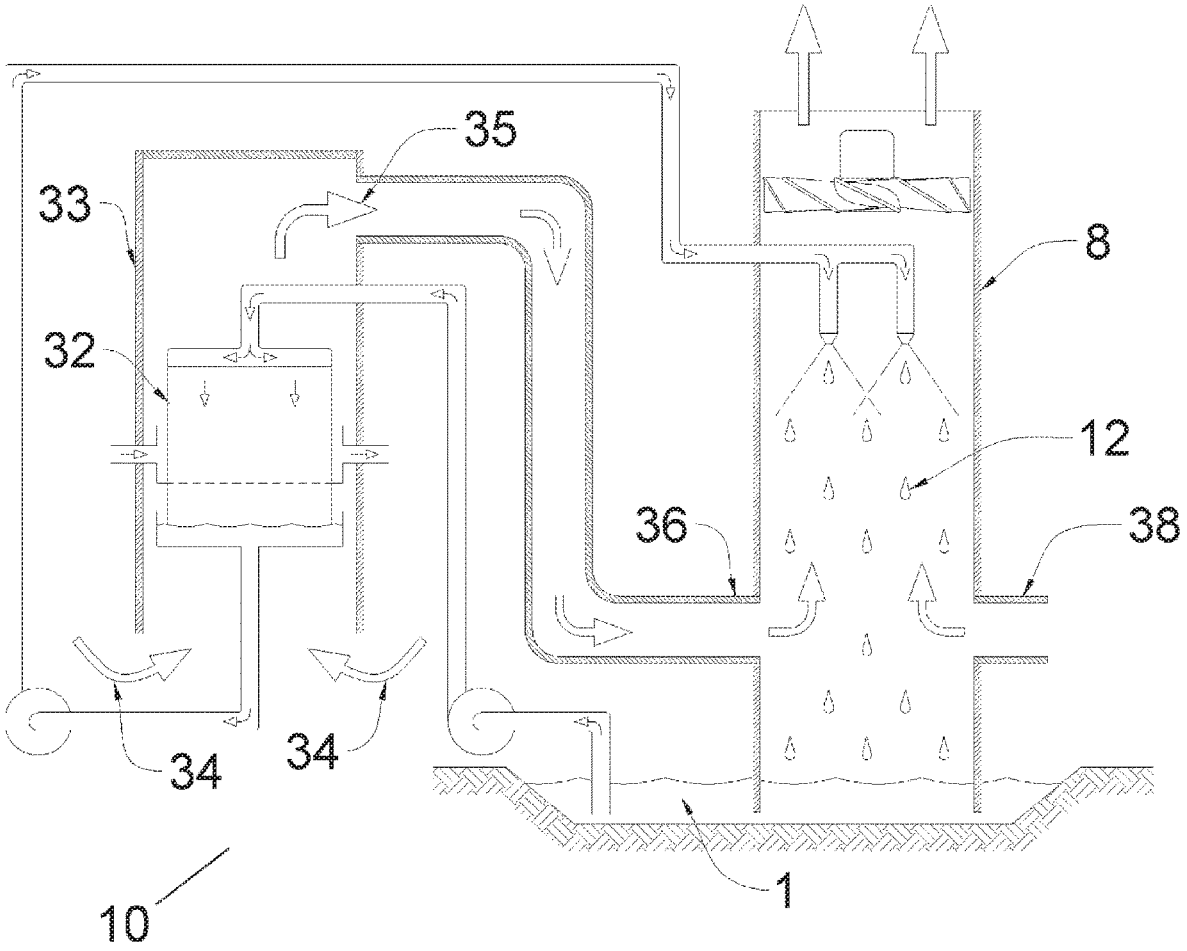
FIG. 6 is a schematic of an alternate embodiment of the present invention incorporating a falling-film process heat exchanger to precondition the air contactor inlet air.

A further embodiment of the heat dissipation system 10 is illustrated in drawing FIG. 6. The heat dissipation system 10 incorporates the film-cooled process sensible heat exchanger to condition a portion of the airflow entering air contactor latent heat exchanger 8. Illustrated in drawing FIG. 6, process sensible heat exchanger 32 is cooled by a falling film of hygroscopic working fluid inside housing 33. Ambient air 34 is drawn into process sensible heat exchanger housing 33 and flows past the film-cooled heat exchanger where it receives some quantity of evaporated moisture from the hygroscopic fluid film. The higher-humidity airflow at 35 is conducted to inlet 36 of air contactor latent heat exchanger 8 where the airflow 35 is flowing countercurrent to the spray of hygroscopic working fluid 12. Additional ambient air may also be introduced to the inlet of air contactor latent heat exchanger 8 through alternate opening 38.

In the embodiment illustrated in drawing FIG. 6, moisture vapor released from process sensible heat exchanger 32 is added to the air contactor's inlet airstream and thereby increases the moisture content by a finite amount above ambient humidity levels. This effect will tend to inhibit moisture evaporation from hygroscopic working fluid 12 and will result in a finite increase to the steady-state moisture content of reservoir hygroscopic solution 1 so that the desiccant-based hygroscopic fluid remains stable (hygroscopic desiccant in solution) to prevent crystallization of the desiccant from the desiccant-based hygroscopic fluid. The embodiment illustrated in drawing FIG. 6 may be preferred in arid environments and during dry weather in order to counteract excessive evaporation of moisture from the hygroscopic working fluid.

Figure 7:
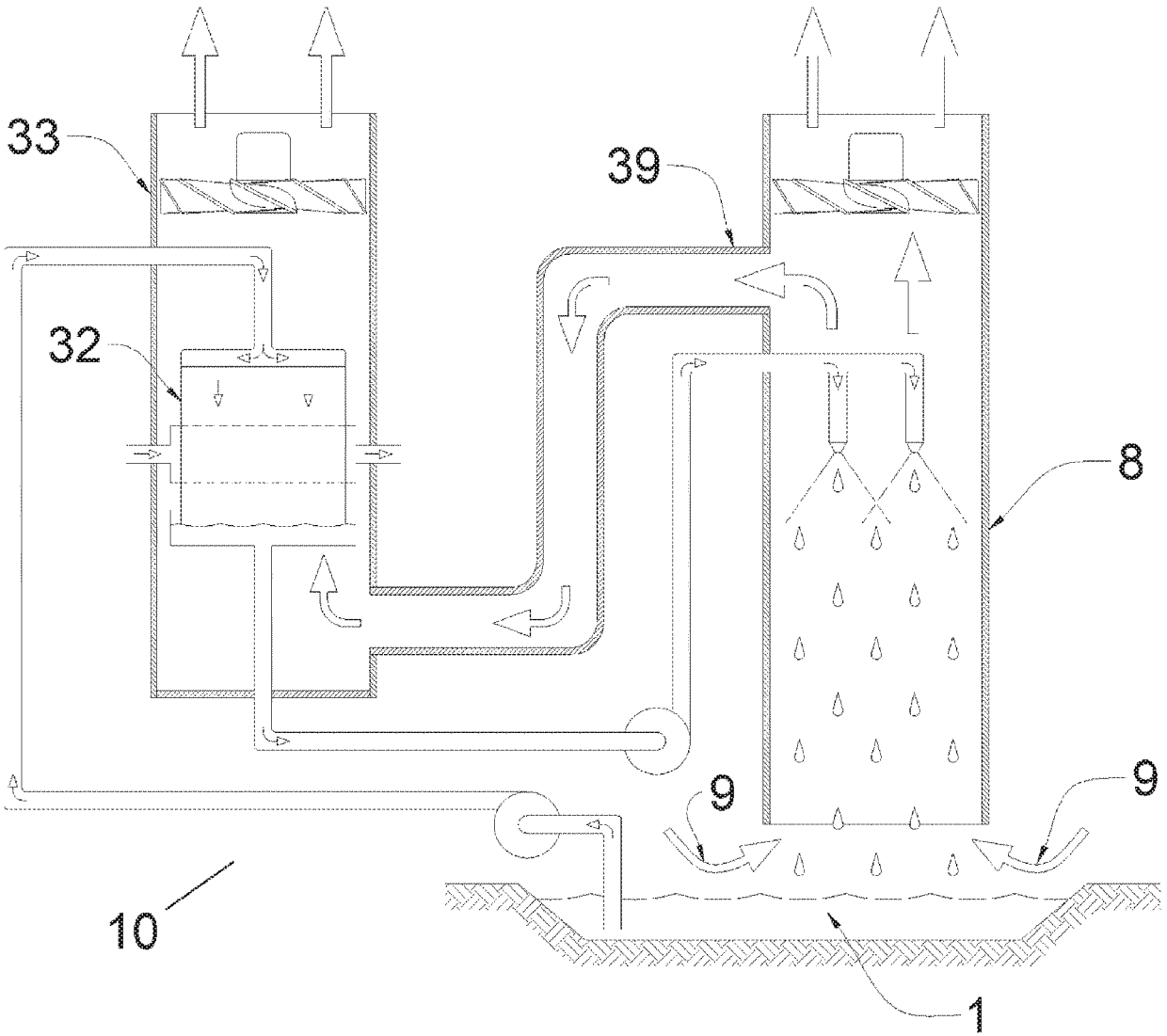
FIG. 7 is a schematic of an alternate embodiment of the present invention incorporating the air contactor to precondition a falling-film process heat exchanger.

A further embodiment of the heat dissipation system 10 is illustrated in drawing FIG. 7. The heat dissipation system 10 incorporates the air contactor latent heat exchanger 8 to condition the airflow passing the film-cooled process sensible heat exchanger 33. As illustrated in drawing FIG. 7, a portion of the airflow exiting air contactor latent heat exchanger 8 at outlet 39 is conducted to the inlet of process heat exchanger housing 33. This airflow then flows past film-cooled process sensible heat exchanger 32 where it receives moisture from hygroscopic film moisture evaporation.

During high ambient humidity conditions when the net moisture vapor content of reservoir hygroscopic solution 1 is increasing, the air at outlet 39 will have lower moisture vapor content than the moisture vapor content of ambient air 9 entering the air contactor latent heat exchanger 8. Therefore, some advantage will be gained by exposing film-cooled process sensible heat exchanger 32 to this lower-humidity airstream from outlet 39 rather than the higher-humidity ambient air. The lower-humidity air will encourage evaporation and latent heat transfer in film-cooled sensible process heat exchanger 32. The embodiment illustrated in drawing FIG. 7 may be preferred for high-humidity conditions since it will enhance the latent component of heat transfer when a film-cooled process heat exchanger, such as 32, is used. However, in any event, during operation of the heat dissipation system 10, the desiccant-based hygroscopic fluid remains stable (hygroscopic desiccant in solution) to prevent crystallization of the desiccant from the desiccant-based hygroscopic fluid.

Figure 8:
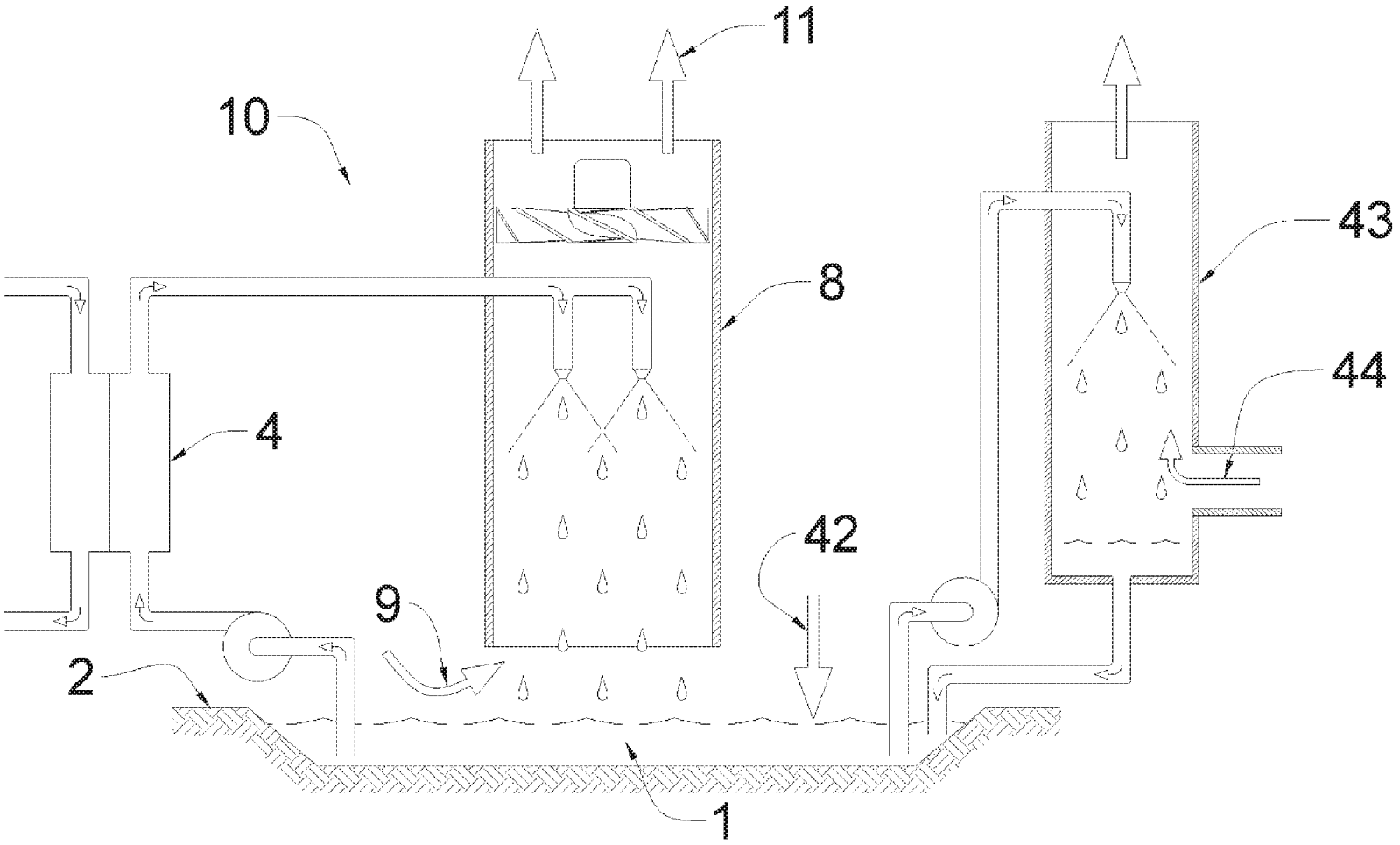
FIG. 8 is a schematic of an alternate embodiment of the present invention incorporating alternate means to increase the moisture content of the working fluid.

A further embodiment of the heat dissipation system 10 is illustrated in drawing FIG. 8. The heat dissipation system 10 uses an alternate means for increasing the hygroscopic working fluid moisture content above those that could be obtained by achieving equilibrium with the ambient air. The first alternative presented in drawing FIG. 8 is to increase the moisture content of hygroscopic working fluid 1 directly by addition of liquid water stream 42. In the other alternative presented, hygroscopic working fluid 1 is circulated through absorber latent heat exchanger 43 where it is exposed to gas stream 44. Gas stream 44 has higher moisture vapor availability compared to ambient air 9. Therefore, the hygroscopic working fluid that passes through absorber latent heat exchanger 43 is returned to reservoir 2 having a higher moisture content than that achievable in air contactor latent heat exchanger 8. The source of gas stream 44 may include ambient air into which water has been evaporated either by misting or spraying, an exhaust stream from a drying process, an exhaust stream of high-humidity air displaced during ventilation of conditioned indoor spaces, an exhaust stream from a wet evaporative cooling tower, or a flue gas stream from a combustion source and the associated flue gas treatment systems. The benefit of such alternatives illustrated in drawing FIG. 8 is to increase the moisture content of hygroscopic working fluid 1 during periods of low heat dissipation demand, such as at night, for the purpose of providing additional latent cooling capacity during periods when heat dissipation demand is high so that the desiccant-based hygroscopic fluid remains stable (hygroscopic desiccant in solution) to prevent crystallization of the desiccant from the desiccant-based hygroscopic fluid.

Figure 9:
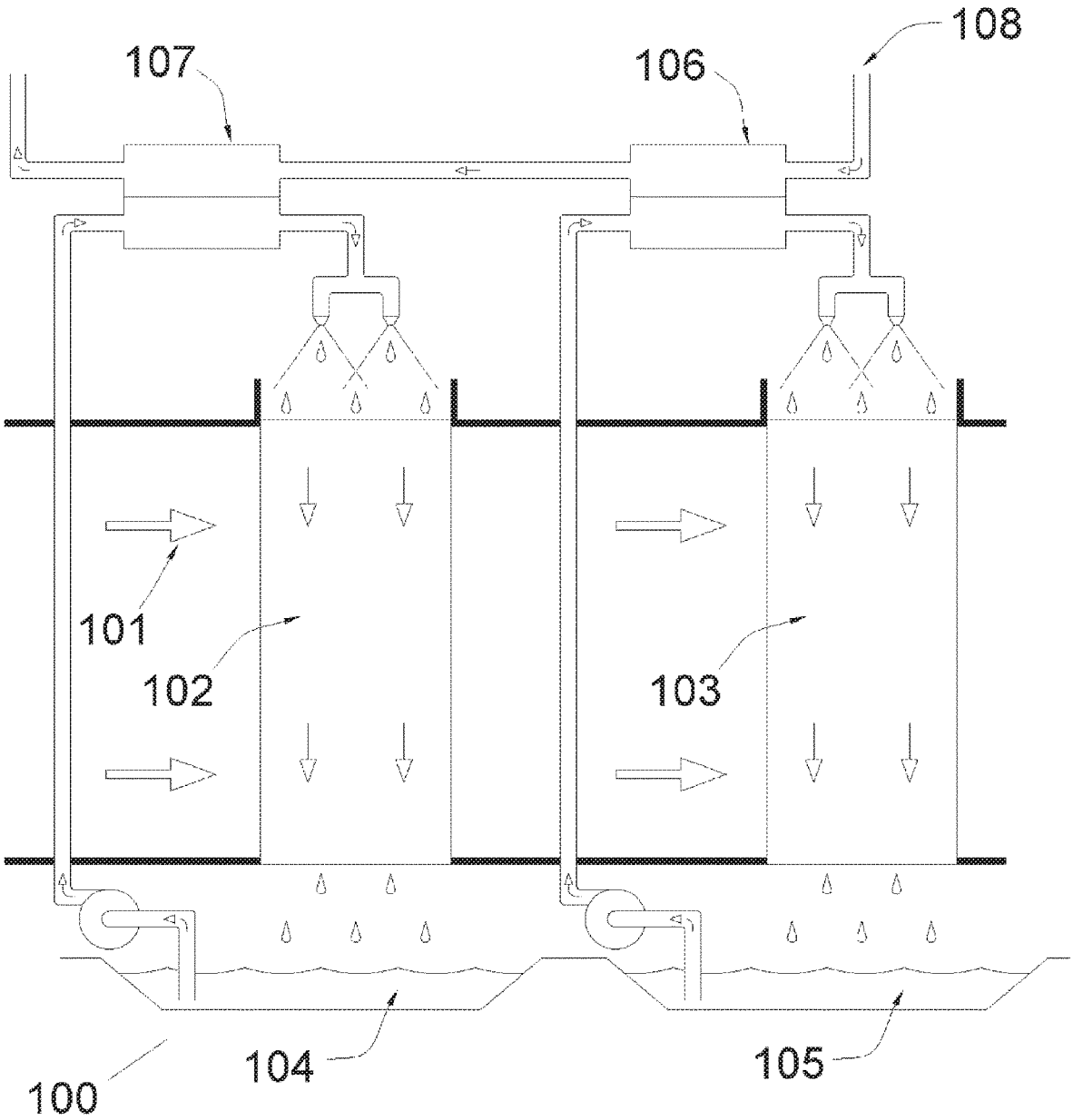
FIG. 9 is a schematic of an alternative embodiment of the present invention incorporating staged multiple cross-flow air contactors.

Referring to drawing FIG. 9, a further embodiment of heat dissipation system 100 of the present invention is illustrated using staged multiple crossflow air contactor, direct-contact latent heat exchangers 102 and 103. This embodiment of the present invention includes means to regulate the amount of sensible heat transfer versus latent heat transfer taking place in heat dissipation system 100. In this embodiment of the invention, thermal energy is dissipated at a higher (but still allowable) temperature during cooler ambient periods in order to maintain cooling capacity during peak ambient temperatures.

This embodiment of the heat dissipation system 100 of the invention uses staged sequences of crossflow air contactor heat exchangers 102 and 103 used in conjunction with the process sensible heat exchangers 106 and 107 that interface with the thermal load. Feedback from one stage is passed to adjacent stages in the form of increased vapor pressure in air streams 101 and reduced temperature of the hygroscopic working fluids 104, 105 servicing the thermal load. Combined, these mechanisms reduce the proportion of the thermal load passed to the initial, cooler stage 102 (which contain much of the moisture absorbed during cooler periods) and prevent excessive evaporation from the final, hotter stage 103.

As illustrated in drawing FIG. 9, the staged configuration heat dissipation system 100 utilizes a flow of ambient air 101 that enters the desiccant-to-air crossflow air contactor heat exchanger and passes through the first stage of liquid-air contact 102, and subsequently through the second stage of liquid-air contact 103. Contacting sections 102 and 103 are depicted as crossflow air contactor latent heat exchangers having liquid film-supporting media that is wetted with fluid drawn from reservoirs 104 and 105, respectively. The fluid to be cooled enters the system at 108 and first enters sensible heat exchanger 106 where it undergoes heat transfer with desiccant solution from the second-stage reservoir 105. The partially cooled fluid then enters heat exchanger 107 where it undergoes further heat transfer with desiccant solution from the first-stage reservoir 104.

Key characteristics of this embodiment of the invention include 1) substantially separate working fluid circuits that allow a desiccant concentration gradient to become established between the circuits; 2) each circuit has means for direct contact with an ambient airflow stream which allows heat and mass transfer to occur, and each circuit has means for indirect contact with the fluid to be cooled so that sensible heat transfer can occur; 3) sequential contact of the airflow with each desiccant circuit stage; 4) sequential heat exchange contact of each desiccant circuit with the fluid to be cooled such that the sequential direction of contact between the fluid to be cooled is counter to the direction of contact for the ambient air flow; and finally, 5) the ability to vary the distribution of the heat load among the circuits so as to maximize the amount of reversible moisture cycling by the initial circuit(s) while preventing crystallization of the desiccant from the desiccant-based hygroscopic fluid.

The method of direct air-desiccant solution contact can be conducted using any known-in-the-art heat exchanger, including a spray contactor heat exchanger, falling-film heat exchanger, or wetted structured fill media heat exchanger provided that the desiccant-based hygroscopic fluid remains stable (hygroscopic desiccant in solution) to prevent crystallization of the desiccant from the desiccant-based hygroscopic fluid. A preferred embodiment incorporates falling-film media heat exchanger, 102 and 103, operating in a crossflow configuration. The attached film prevents the formation of fine droplets or aerosols that could be carried out with the air stream as drift, while the crossflow configuration allows for convenient segregation of the desiccant circuits.

Figure 10:
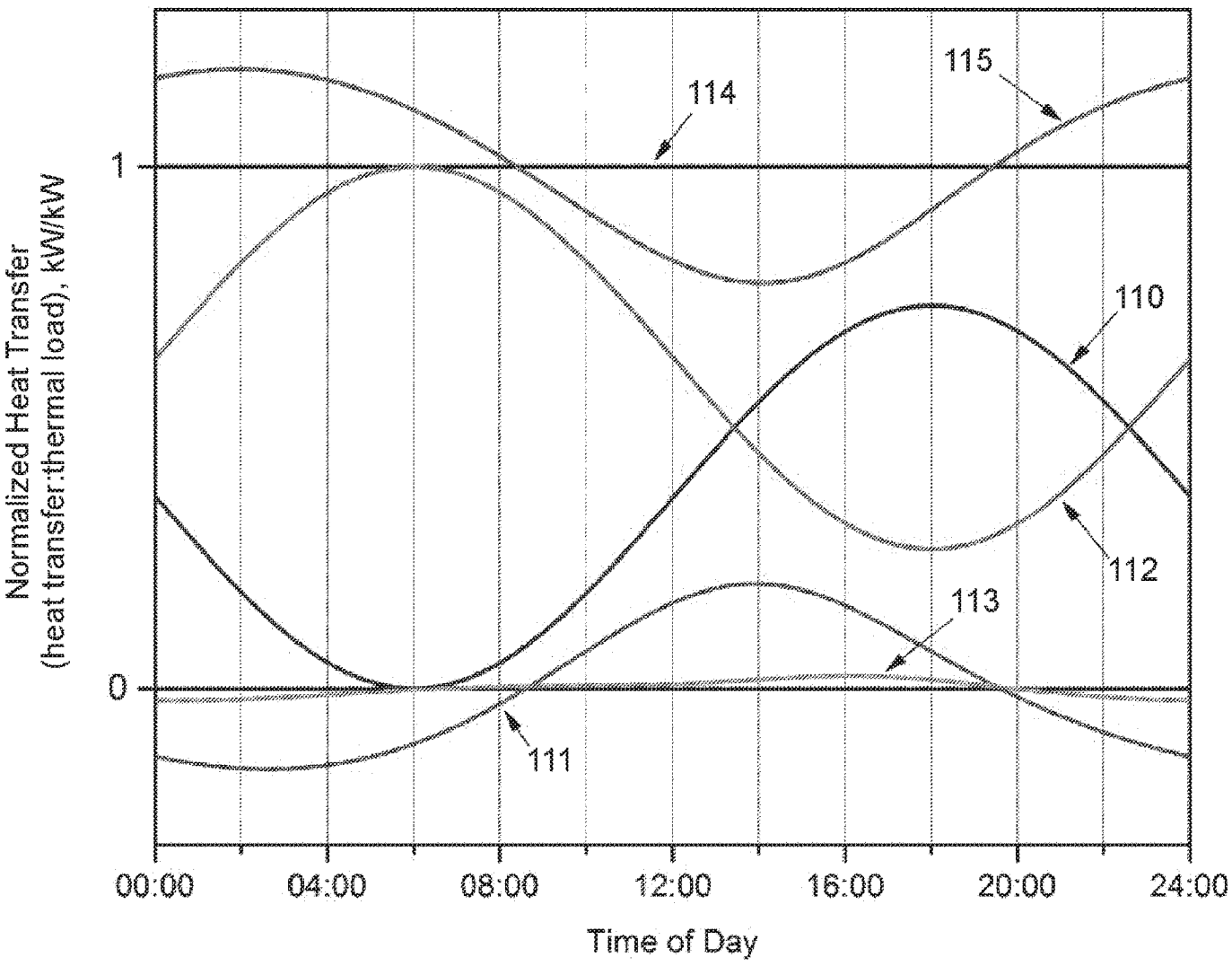
FIG. 10 illustrates the operation of the alternative embodiment of the present invention illustrated in FIG. 9

An example illustrating the preferred operation of the heat dissipation system 100, illustrated in drawing FIG. 9, is illustrated in drawing FIG. 10, that is a plot of the heat-transfer components for a two-stage heat dissipation system 100 using desiccant solution in both stages. In reference to drawing FIG. 9, contacting section 102 would comprise Stage 1, and contacting section 103 would comprise stage 2. Each stage of the heat dissipation system 100 has sensible and latent components of heat transfer; the sensible component for Stage 1 is identified as 110, and the Stage 1 latent component is 111. The sensible heat-transfer component and latent heat-transfer component for Stage 2 are identified as 112 and 113, respectively. The total sensible heat rejected by the thermal load is constant for this example and is identified as 114; furthermore, it serves as the normalizing factor for all of the other heat-transfer components and has a value of 1 kW/kW. This is the thermal load transferred to the cooling system in heat exchangers 106 and 107 in drawing FIG. 9. The final heat-transfer component in drawing FIG. 10 is the sensible heat transferred to the air stream 115 as would be determined from the temperature change of the air across both stages of direct-contact media in drawing FIG. 9.

The phases of operation depicted in drawing FIG. 10 can be distinguished based on the distribution of the total thermal load 114, among Stages 1 and 2, e.g., 110 and 112, respectively. Around 6:00 as illustrated in drawing FIG. 10, this ratio is at a minimum; almost the entire thermal load is being sensibly dissipated by Stage 2 and very little in Stage 1. However, during this period, the hygroscopic fluid in Stage 1 is being recharged by absorbing moisture from the atmosphere as indicated by the negative latent heat value at this time (111). The associated heat of absorption is rejected to the atmosphere in addition to the constant thermal load (114) as indicated by the air sensible heat transfer (115) being higher than the total thermal load.

Between approximately 8:00 and 16:00 as illustrated in drawing FIG. 10, more of the thermal load is transferred from Stage 2 to Stage 1 as the ambient dry-bulb temperature begins to rise. The profile of this progressive transfer of thermal load is chosen to maintain the desired cooling capacity and to control the evaporation of the atmospheric moisture previously absorbed in the Stage 1 hygroscopic fluid. Given the rapid nature of evaporative cooling compared to sensible heat transfer, the thermal load is gradually introduced to Stage 1 in order to obtain maximum benefit of the absorbed moisture, which in drawing FIG. 10 occurs at approximately 14:00 or midafternoon, typically when ambient air temperatures peak for the day. Also at this time, the sensible heat transfer to the air is at a minimum because a portion of the thermal load is being dissipated through the latent cooling, primarily in Stage 1.

At approximately 18:00, as illustrated in drawing FIG. 10, the ratio of Stage 1 to Stage 2 sensible heat transfer is at a maximum; beyond this time, the thermal load is progressively shifted back to Stage 2 as the ambient dry-bulb temperature cools. Transferring heat load from the Stage 1 hygroscopic fluid also allows it to cool and begin to reabsorb moisture from the air.

Operation in the manner described cycles the desiccant solution in Stage 1 between the extreme conditions of 1) minimal thermal load with simultaneous exposure to the minimum daily ambient temperatures and 2) maximum thermal load with exposure to peak daily ambient temperatures. This arrangement increases the mass of water that is reversibly exchanged in the Stage 1 fluid per unit mass of desiccant in the system. Without such "stretching" of the desiccant solution's moisture capacity, an excessively large quantity of solution would be needed to provide the same level of latent-based thermal energy storage.

Moisture vapor absorption and desorption from Stage 1 consequently decreases or increases the vapor pressure experienced at Stage 2, which depresses the latent heat transfer of Stage 2 (item 113). Therefore, the importance of utilizing the Stage 2 hygroscopic fluid as a thermal storage medium is greatly diminished, and the needed quantity of this hygroscopic fluid is reduced compared to the hygroscopic fluid of Stage 1.

Obviously, the daily pattern of ambient air temperatures is not as regular and predictable as that used for the simulation results of drawing FIG. 10. However, the value of this embodiment of the heat dissipation system 10 of the invention is that it is a method to alter the time constant for the cooling system so that cyclic variations having a period on the order of 24 hours and amplitude on the order of those typically encountered in ambient weather can be dampened, and the amount of latent heat transfer is controlled so as to prevent crystallization of the desiccant from the desiccant-based hygroscopic fluid.

While the diagram of drawing FIG. 9 shows only two distinct stages of air contacting and thermal load heat transfer, it is understood that the concept can be extended to include multiple sequences of such stages and that the general conditions just outlined would apply individually to any two subsequent stages or, more broadly, across an entire system between a set of initial contacting stages and a set of following stages.

In the outlined mode of operation, the maximum water-holding capacity is reached when the initial stage(s) have a relatively lower desiccant concentration compared to the following stage(s). The series of stages could contain the same desiccant maintained in a stratified fashion so as to maintain a distinct concentration gradient. Alternatively, the separate stages could employ different desiccant solutions in order to meet overall system goals, including moisture retention capacity and material costs. However, in any event, during operation of the entire heat dissipation system 100, the desiccant-based hygroscopic fluid of each stage must remain stable (hygroscopic desiccant in solution) to prevent crystallization of the desiccant from the desiccant-based hygroscopic fluid.

A further embodiment of the heat dissipation system 100 of the present invention occurs where the primary stage circuit contains pure water and only the subsequent following stage(s) contain a hygroscopic desiccant solution. In this configuration of the heat dissipation system 100 of the present invention, the previously mentioned benefits of conserving latent heat dissipation and conversion of evaporative heat transfer to sensible heating of the air are preserved. However, in this case, the vapor pressure of the initial stage fluid is never below that of the ambient air, and moisture is not absorbed in the initial stage during cooler nighttime temperatures as is the case when a desiccant fluid is used. Again, in any event, during operation of the entire heat dissipation system 100, the desiccant-based hygroscopic fluid of each stage must remain stable (hygroscopic desiccant in solution) to prevent crystallization of the desiccant from the desiccant-based hygroscopic fluid.

Figure 11:
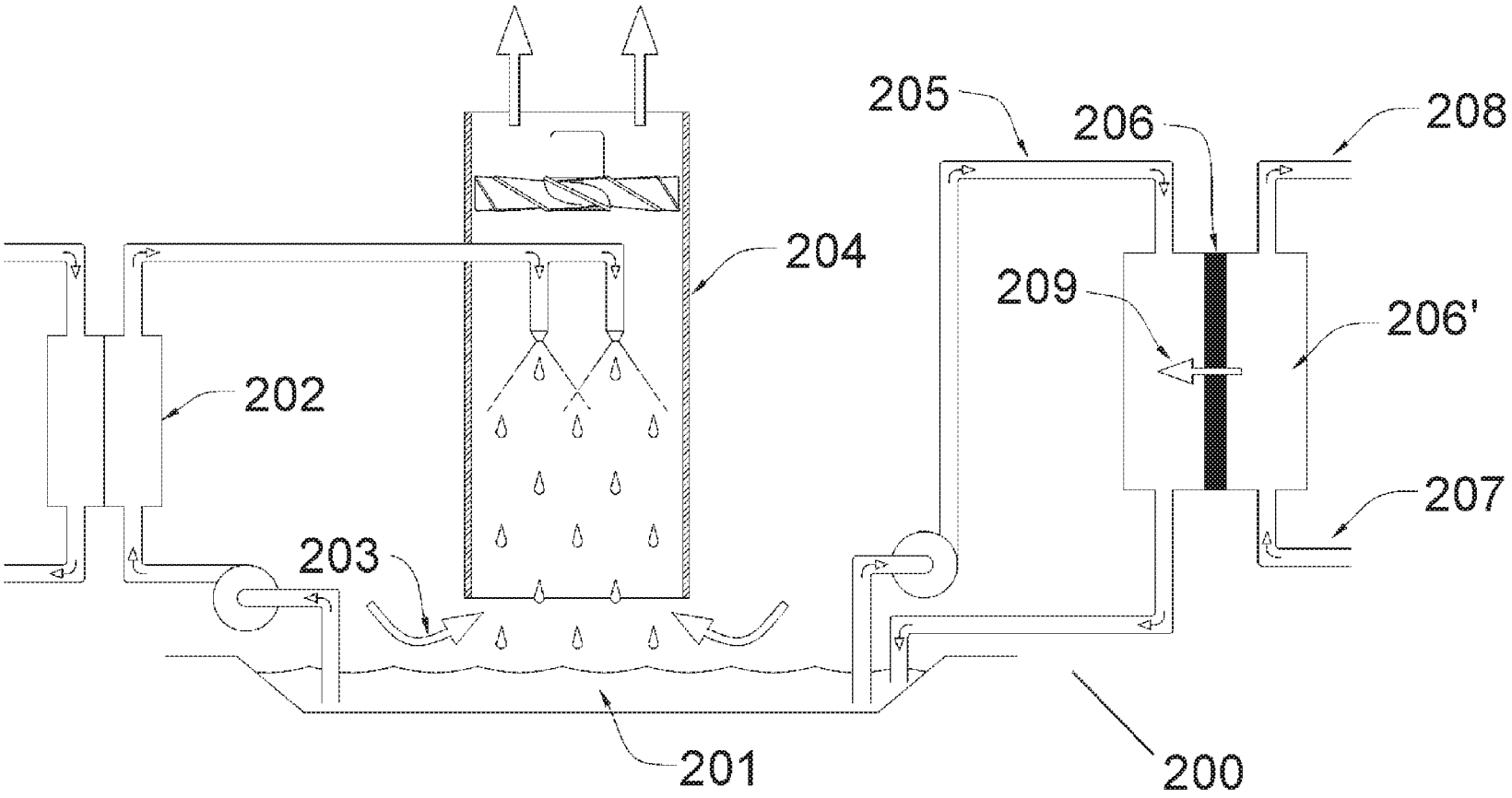
FIG. 11 is a schematic of an alternative embodiment of the present invention including an osmosis membrane moisture extraction cell.

Referring to drawing FIG. 11, an alternative embodiment of a method and apparatus of the heat dissipation systems is described for supplementing the water content of a liquid hygroscopic desiccant working fluid in a liquid hygroscopic desiccant-based heat dissipation system 200. In the heat dissipation system 200, the inherent osmotic gradient that exists between the liquid hygroscopic desiccant and a source of degraded-quality water is used to extract relatively pure water through a forward osmosis membrane 206 from the degraded source to the desiccant working fluid. The water transferred by forward osmosis is of sufficient quality to prevent excessive accumulation of undesirable constituents in the hygroscopic desiccant fluid circuit and, therefore, greatly expands the range of water quality that can be used to supplement the operation of a liquid hygroscopic desiccant-based heat dissipation system 200 provided that the desiccant based hygroscopic fluid remains stable (hygroscopic desiccant in solution) to prevent crystallization of the desiccant from the desiccant-based hygroscopic fluid.

Water added to the working fluid of the heat dissipation system 200 provides several benefits to improve the performance of transferring heat to the atmosphere. First, the added water increases the moisture vapor pressure of the hygroscopic desiccant solution, which increases the proportion of latent cooling that can take place when the hot hygroscopic desiccant is cooled by direct contact with ambient air. This effectively increases the quantity of heat that can be dissipated per unit of desiccant-to-air contacting surface. Second, added water content lowers the saturation temperature of the hygroscopic desiccant solution, which is the minimum temperature that the solution can be cooled to by evaporative cooling. By lowering the hygroscopic desiccant solution's saturation temperature, lower cooling temperatures can be achieved for otherwise equivalent atmospheric conditions. Third, water is generally a superior heat-transfer fluid compared to the desiccant hygroscopic solutions that would be employed in a heat dissipation system, such as 200, and adding a higher proportion of it to the hygroscopic desiccant solution will improve the hygroscopic desiccant solution's relevant thermal properties. In a desiccant-based heat dissipation system 200, the cool desiccant hygroscopic fluid is used to sensibly absorb heat from the thermal load in a heat exchanger, so it is preferred that the fluid have good heat-transfer properties. Water addition increases the desiccant hygroscopic solution's specific heat capacity, and it reduces the viscosity. Combined, these property improvements can lower the parasitic pumping load by reducing the needed solution flow rate for a given heat load and by reducing the desiccant hygroscopic solution's resistance to pumping.

In addition to improving the performance of a desiccant hygroscopic fluid heat dissipation system 200, the disclosed invention of the heat dissipation system 200 can also be viewed as an energy-efficient way to reduce the volume of a degraded water source that poses a difficult disposal challenge. Forward osmosis is a highly selective process that can be used to separate water from a wide array of organic and inorganic impurities found in degraded water sources, and when driven by the osmotic gradient between the water source and the desiccant in a heat dissipation system, it is also energy-efficient. Eliminating water in this manner could be an integral part of water management for facilities with zero-liquid-discharge mandates.

As illustrated in drawing FIG. 11, the alternative embodiment is a liquid desiccant-based heat dissipation system 200 coupled with a forward osmosis stage for supplementary water harvesting. General operation of the heat dissipation system 200 comprises circulating a liquid desiccant hygroscopic solution 201 through sensible heat exchanger 202 where it absorbs heat from the thermal load. Heated desiccant hygroscopic solution is directly exposed to a flow of ambient air 203 in desiccant-to-air latent heat exchanger 204 where a combination of sensible heat transfer and latent heat transfer takes place to cool the desiccant hygroscopic liquid so that it can continually transfer heat from the thermal load.

Supplementary water is added to the liquid desiccant solution through a second circuit of desiccant hygroscopic solution 205 that flows along one side of forward osmosis membrane 206. On the opposite side of forward osmosis membrane 206 is a flow of degraded quality water from inlet 207 to outlet 208 on one side of forward osmosis stage heat exchanger 206'. Since the osmotic pressure of the desiccant hygroscopic solution 201 is higher than that of the degraded water source flowing through osmosis stage heat exchanger 206', an osmotic pressure gradient is established that is used to transfer water 209 across forward osmosis membrane 206. Transferred water 209 becomes mixed with desiccant hygroscopic solution 201 and is used in the heat dissipation circuit.

Figure 12:
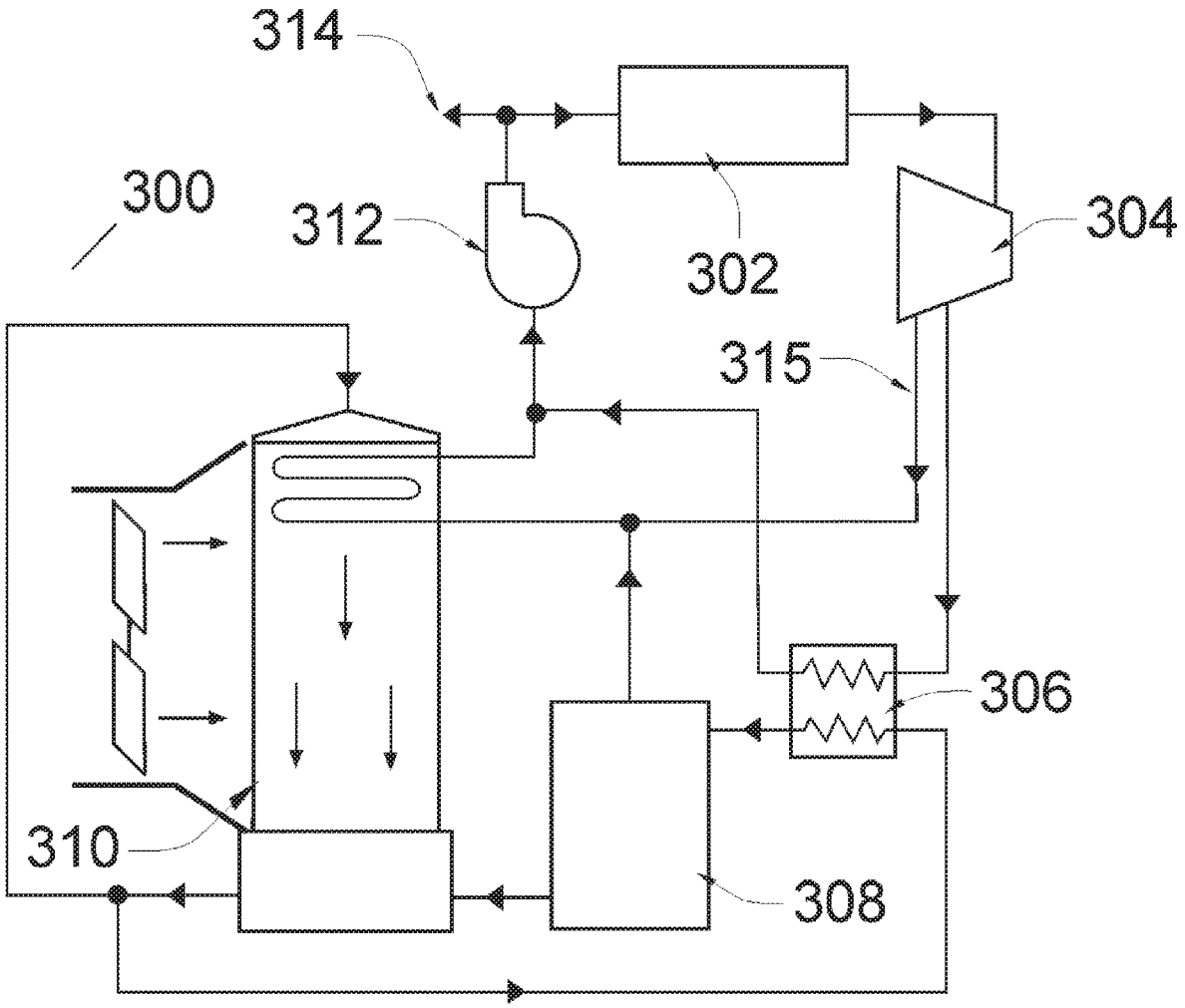
FIG. 12 is a schematic of an alternative embodiment of the present invention including as vacuum evaporator.

Moisture in solution may also be extracted from the desiccant hygroscopic liquid in the form of liquid water when excess cooling capacity is present. Drawing FIG. 12 illustrates an embodiment of the heat dissipation system of the present invention used in a steam-type power system 300 including a desiccant evaporator 308 so that released vapor from the desiccant evaporator 308 meets the makeup water and condenses directly in the plant's hygroscopic fluid-based heat dissipation system 310. The steam-type power system 300 includes a boiler 302 producing steam for a power turbine 304. Primary steam turbine exhaust 315 is routed to hygroscopic fluid-based heat dissipation system 310 for condensation back to boiler feed water. A secondary steam exhaust flow is routed to sensible heat exchanger 306 to heat a slipstream of desiccant-based hygroscopic fluid before it enters hygroscopic fluid vacuum evaporator 308. The desiccant evaporator 308 comprises a vacuum-type evaporator for evaporating the water from desiccant hygroscopic water from the sensible heat exchanger 306 for the evaporated water to be used as makeup water for the boiler with any excess water exiting the system 300 through excess water tap 314 for storage for subsequent use in the system 300. Depending upon the type of desiccant hygroscopic liquid used in latent heat exchanger 310 which is subsequently evaporated by the desiccant hygroscopic evaporator 308, the amount of excess free water will vary from the desiccant hygroscopic evaporator 308 for use as makeup water for the system 300. However, in any event, during operation of the heat dissipation system, desiccant based hygroscopic fluid must remain stable (hygroscopic desiccant in solution) to prevent crystallization of the desiccant from the desiccant-based hygroscopic fluid.

The foregoing discussion discloses and describes merely exemplary embodiments of the present invention. One skilled in the art will readily recognize from such discussion, and from the accompanying drawings and claims, that various changes, modifications, and variations can be made therein without departing from the spirit and scope of the invention as defined in the following claims.

The invention claimed is:

1. A method for heat dissipation using a hygroscopic working fluid comprising:

removing heat from a process heat exchanger to absorb thermal energy for dissipation in a fluid-air contactor using the hygroscopic working fluid, wherein the hygroscopic working fluid comprises a desiccant;

flowing an air stream from outside a compartment of the fluid-air contactor comprising a falling-film contactor heat exchanger to inside the compartment of the fluid-air contactor during active flow times, wherein the air stream comprises a source of ambient air outside the fluid-air contactor, such that the inside of the compartment of the fluid-air contactor comprises the air stream;

flowing a gas stream having more water vapor than the ambient air from outside the compartment of the fluid-air contactor to the inside of the compartment, such that the inside of the compartment of the fluid-air contactor comprises a mixture comprising the air stream and the gas stream;

flowing the hygroscopic working fluid into the compartment of the fluid-air contactor comprising flowing the hygroscopic working fluid into one or more distribution headers of the falling-film contactor heat exchanger to wet a falling-film wick and form a film of the hygroscopic working fluid thereon to transfer moisture inside the compartment between the hygroscopic working fluid and the air stream or the mixture comprising the air stream and the gas stream and to transfer thermal energy from the hygroscopic working fluid to the air stream or the mixture comprising the air stream and the gas stream;

maintaining the hygroscopic working fluid to prevent crystallization of the desiccant from the hygroscopic working fluid comprising storing excess moisture in the hygroscopic fluid gained from the mixture comprising the air stream and the gas stream in the fluid-air contactor during minimum daily ambient temperatures of the ambient air and evaporating the excess moisture from the hygroscopic fluid to the air stream in the fluid-air contactor during peak daily ambient temperatures of the ambient air; and adjusting the active flow times of the gas stream to the inside of the compartment of the fluid-air contactor such that the active flow times occur only when moisture absorption from the gas stream to the hygroscopic fluid provides a net benefit to cyclic cooling capacity of the hygroscopic fluid, so that the moisture stored in the hygroscopic working fluid is counterbalanced by an equivalent amount of moisture evaporated from the hygroscopic working fluid over the daily ambient temperature cycle.

2. The method for heat dissipation according to claim 1, wherein the hygroscopic working fluid comprises an aqueous solution including at least one of sodium chloride (NaCl), calcium chloride ($CaCl_2$)), magnesium chloride ($MgCl_2$), lithium chloride (LiCl), lithium bromide (LiBr), zinc chloride ($ZnCl_2$), sulfuric acid ($H_2SO_4$), sodium hydroxide (NaOH), sodium sulfate ($Na_2SO_4$), potassium chloride (KCl), calcium nitrate ($Ca[NO_3]_2$), potassium carbonate ($K_2CO_3$), ammonium nitrate ($NH_4NO_3$), ethylene glycol, diethylene glycol, propylene glycol, triethylene glycol, dipropylene glycol, and any combination thereof.

3. The method for heat dissipation according to claim 1, wherein the gas stream comprises at least one of ambient air into which water has been evaporated either by misting or spraying, an exhaust stream from a drying process, an exhaust stream of high-humidity air displaced during ventilation of conditioned indoor spaces, an exhaust stream from a wet evaporative cooling tower, and a flue gas stream from a combustion source and the associated flue gas treatment systems.

4. The method for heat dissipation according to claim 1, wherein the process heat exchanger comprises one of a condenser of a thermodynamic power production or a refrigeration cycle, the air stream and the gas stream enter the inside of the compartment of the fluid-air contactor via separate inlets in the compartment of the fluid-air contactor such that the air stream is free of mixing with the gas stream before the air stream and gas stream each enter the inside of the compartment of the fluid-air contactor via the separate inlets, or a combination thereof.

5. The method for heat dissipation according to claim 1, wherein the fluid-air contactor operates in at least one relative motion chosen from countercurrent, cocurrent, and crossflow operation.

6. The method for heat dissipation according to claim 1, wherein the fluid-air contactor is enhanced by at least one of a forced or induced draft of the air stream by a powered fan, the natural convection airflow generated from buoyancy differences between heated and cooled air, and the induced flow of air generated by the momentum transfer of a spray of the hygroscopic working fluid into the air.

7. The method for heat dissipation according to claim 1, wherein said air stream is supplemented with additional humidity from at least one of a spray, mist, or fog of water directly into the stream, an exhaust gas stream from a drying process, an exhaust gas stream consisting of high-humidity rejected air displaced during the ventilation of conditioned indoor spaces, an exhaust stream from a wet evaporative cooling tower, and an exhaust flue gas stream from a combustion source and any associated flue gas treatment equipment.

8. The method for heat dissipation according to claim 1, further comprising directly adding liquid water to the hygroscopic working fluid to enhance overall heat transfer performance.

9. The method for heat dissipation according to claim 1, wherein the process heat exchanger is cooled by a flowing film of said hygroscopic working fluid enabling both sensible and latent heat transfer to occur during thermal energy absorption from a process fluid.

10. The method for heat dissipation according to claim 9, wherein the process heat exchanger is placed at an inlet to said fluid-air contactor for raising inlet airflow humidity levels.

11. The method for heat dissipation according to claim 9, wherein the process heat exchanger is placed at an outlet of said fluid-air contactor for receiving air dehumidified with respect to the ambient air atmosphere.

12. A heat dissipation method comprising:

removing heat from a process heat exchanger to absorb thermal energy for dissipation in a fluid-air contactor using a hygroscopic working fluid having a vapor pressure less than water, wherein the hygroscopic working fluid comprises a desiccant;

flowing an air stream from outside a compartment of the fluid-air contactor comprising a falling-film contactor heat exchanger to inside the compartment of the fluid-air contactor during active flow times, such that the inside of the compartment of the fluid-air contactor comprises the air stream, wherein the air stream has a daily temperature cycle;

flowing a gas stream having more water vapor than the air stream from outside the compartment of the fluid-air contactor to the inside of the compartment, such that the inside of the compartment of the fluid-air contactor comprises a mixture comprising the air stream and the gas stream;

flowing the hygroscopic working fluid into the compartment of the fluid-air contactor comprising flowing the hygroscopic working fluid into one or more distribution headers of the falling-film contactor heat exchanger to wet a falling-film wick and form a film of the hygroscopic working fluid thereon to transfer moisture inside the compartment between the hygroscopic working fluid and the air stream or the mixture comprising the air stream and the gas stream and to transfer thermal energy from the hygroscopic working fluid to the air stream or the mixture comprising the air stream and the gas stream;

maintaining the hygroscopic working fluid to prevent crystallization of the desiccant from the hygroscopic working fluid comprising storing excess moisture in the hygroscopic fluid gained from the mixture comprising the air stream and the gas stream in the fluid-air contactor during minimum daily temperatures of the air stream and evaporating the excess moisture from the hygroscopic fluid to the air stream in the fluid-air contactor during peak daily temperatures of the air stream; and adjusting the active flow times of the gas stream to the inside of the compartment of the fluid-air contactor such that the active flow times occur only when moisture absorption from the gas stream to the hygroscopic fluid provides a net benefit to cyclic cooling capacity, so that the moisture stored in the hygroscopic working fluid is counterbalanced by an equivalent amount of moisture evaporated from the hygroscopic working fluid over the daily temperature cycle.

13. The method for heat dissipation according to claim 12, wherein the hygroscopic working fluid comprises an aqueous solution including at least one of sodium chloride (NaCl), calcium chloride ($CaCl_2$)), magnesium chloride ($MgCl_2$), lithium chloride (LiCl), lithium bromide (LiBr), zinc chloride ($ZnCl_2$), sulfuric acid ($H_2SO_4$), sodium hydroxide (NaOH), sodium sulfate ($Na_2SO_4$), potassium chloride (KCl), calcium nitrate ($Ca[NO_3]_2$), potassium carbonate ($K_2CO_3$), ammonium nitrate ($NH_4NO_3$), ethylene glycol, diethylene glycol, propylene glycol, triethylene glycol, dipropylene glycol, and any combination thereof.

14. The method for heat dissipation according to claim 12, wherein the process heat exchanger comprises one of a condenser of a thermodynamic power production or a refrigeration cycle, the air stream and the gas stream enter the inside of the compartment of the fluid-air contactor via separate inlets in the compartment of the fluid-air contactor such that the air stream is free of mixing with the gas stream before the air stream and gas stream each enter the inside of the compartment of the fluid-air contactor via the separate inlets, or a combination thereof.

15. The method for heat dissipation according to claim 12, wherein the fluid-air contactor operates in at least one relative motion chosen from countercurrent, cocurrent, and crossflow operation.

16. The method for heat dissipation according to claim 12, wherein the fluid-air contactor is enhanced by at least one of the forced or induced draft of the air stream by a powered fan, the natural convection airflow generated from buoyancy differences between heated and cooled air, and the induced flow of air generated by the momentum transfer of a spray of the hygroscopic working fluid into the air.

17. The method for heat dissipation according to claim 12, wherein said gas stream comprises at least one of a gas having additional humidity from at least one of a spray, mist, or fog of water directly into the gas, an exhaust gas stream from a drying process, an exhaust gas stream consisting of high-humidity rejected air displaced during the ventilation of conditioned indoor spaces, an exhaust airstream from a wet evaporative cooling tower, and an exhaust flue gas stream from a combustion source and any associated flue gas treatment equipment.

18. The method for heat dissipation according to claim 12, further comprising directly adding liquid water to the hygroscopic working fluid to enhance overall heat transfer performance.

19. The method for heat dissipation according to claim 12, wherein the process heat exchanger is cooled by a flowing film of said hygroscopic working fluid enabling both sensible and latent heat transfer to occur during thermal energy absorption from a process fluid.

20. The method for heat dissipation according to claim 12, wherein transferring moisture between the hygroscopic working fluid and the mixture comprising air and another gas includes using the fluid-air contactor and a vacuum evaporator.

21. The method for heat dissipation according to claim 12, wherein transferring moisture between the hygroscopic working fluid and the air and another gas includes the use of a forward osmosis membrane of a forward osmosis water extraction cell.

22. The method for heat dissipation according to claim 1, wherein the gas flowstream contains sufficient moisture to prevent moisture loss over a diurnal cycle, the moisture is stored by the hygroscopic working fluid at night, and the amount of moisture stored during the night equals the amount of moisture evaporated from the hygroscopic working fluid during day.

23. The method for heat dissipation according to claim 1, wherein the gas stream enhances humidity in the fluid-air contactor and encourages absorption of moisture into the hygroscopic working fluid.

* * * * *